US012146389B2

(12) United States Patent
Iuell et al.

(10) Patent No.: US 12,146,389 B2
(45) Date of Patent: Nov. 19, 2024

(54) FLUID DIVERTER TOOL, SYSTEM AND METHOD OF DIVERTING A FLUID FLOW IN A WELL

(71) Applicant: Hydra Systems AS, Tananger (NO)

(72) Inventors: Markus Iuell, Stavanger (NO); Roy Inge Jensen, Hafrsfjord (NO); Arnold Østvold, Stavanger (NO)

(73) Assignee: Hydra Systems AS, Tananger (NO)

( * ) Notice: Subject to any disclaimer, the term of this patent is extended or adjusted under 35 U.S.C. 154(b) by 36 days.

(21) Appl. No.: 17/908,164

(22) PCT Filed: Mar. 8, 2021

(86) PCT No.: PCT/NO2021/050059
§ 371 (c)(1),
(2) Date: Aug. 30, 2022

(87) PCT Pub. No.: WO2021/182968
PCT Pub. Date: Sep. 16, 2021

(65) Prior Publication Data

US 2023/0092939 A1 Mar. 23, 2023

(30) Foreign Application Priority Data

Mar. 9, 2020 (NO) ..... 20200284

(51) Int. Cl.
*E21B 34/10* (2006.01)
*E21B 33/126* (2006.01)
(Continued)

(52) U.S. Cl.
CPC ..... *E21B 34/10* (2013.01); *E21B 33/126* (2013.01); *E21B 33/1285* (2013.01); *E21B 33/13* (2013.01); *E21B 37/00* (2013.01)

(58) Field of Classification Search
CPC .... E21B 34/10; E21B 33/126; E21B 33/1285; E21B 33/13; E21B 37/00
See application file for complete search history.

(56) References Cited

U.S. PATENT DOCUMENTS 4,991,653 A 2/1991 Schwegman
6,065,544 A * 5/2000 Holbert ..... E21B 33/127 166/147

(Continued)

FOREIGN PATENT DOCUMENTS

CN 203321508 12/2013
WO 2011/061506 5/2011

(Continued)

OTHER PUBLICATIONS

Norwegian Search Report for No. 20200284, dated Sep. 18, 2020.

(Continued)

*Primary Examiner* — D. Andrews
*Assistant Examiner* — Ronald R Runyan
(74) *Attorney, Agent, or Firm* — Andrus Intellectual Property Law, LLP

(57) ABSTRACT

A fluid diverter tool, system and method of diverting a fluid flow in a in a well, having: a tubular mandrel and a packer element affixed onto an exterior thereof and operable to sealingly engage an inside of a pipe body to divert a flow of a treatment fluid outwards through holes formed in the pipe bod; and a pressure relief device operable to open and relieve pressure from one side to another side of the packer element when exposed to a given pressure differential acting across the pressure relief device from said one side of the packer element, the pressure relief device also adapted to close when exposed to a lower than said given pressure differential acting thereacross from said one side of the packer element.

37 Claims, 11 Drawing Sheets

(51) Int. Cl.

| | |
|---|---|
| ***E21B 33/128*** | (2006.01) |
| ***E21B 33/13*** | (2006.01) |
| ***E21B 37/00*** | (2006.01) |

(56) References Cited

U.S. PATENT DOCUMENTS

| | | | | |
|---|---|---|---|---|
| 9,010,425 | B2 | 4/2015 | Larsen et al. | |
| 9,416,618 | B2 | 8/2016 | Larsen et al. | |
| 9,416,636 | B2 | 8/2016 | Myhre et al. | |
| 9,631,447 | B2 | 4/2017 | Larsen et al. | |
| 9,670,730 | B2 | 6/2017 | Larsen et al. | |
| 9,695,671 | B2 | 7/2017 | Myhre et al. | |
| 9,702,216 | B2 | 7/2017 | Larsen et al. | |
| 9,909,378 | B2 | 3/2018 | Myhre et al. | |
| 10,180,043 | B2 | 1/2019 | Myhre et al. | |
| 10,260,311 | B2 | 4/2019 | Myhre et al. | |
| 10,301,904 | B2 | 5/2019 | Larsen et al. | |
| 2004/0173264 | A1* | 9/2004 | Holder | F16K 17/0433 137/494 |
| 2006/0231253 | A1* | 10/2006 | Vilela | E21B 43/25 166/278 |
| 2008/0283252 | A1 | 11/2008 | Guignard et al. | |
| 2010/0243235 | A1* | 9/2010 | Caldwell | E21B 33/1216 166/387 |
| 2011/0101613 | A1* | 5/2011 | McRobb | F16J 15/006 277/312 |
| 2015/0027705 | A1 | 1/2015 | Larsen et al. | |
| 2017/0254171 | A1 | 9/2017 | Cleven | |
| 2018/0187518 | A1 | 7/2018 | Myhre et al. | |

FOREIGN PATENT DOCUMENTS

| | | | | |
|---|---|---|---|---|
| WO | 2012/096580 | | 7/2012 | |
| WO | 2012/105852 | | 8/2012 | |
| WO | 2013/133718 | | 9/2013 | |
| WO | 2013/133719 | | 9/2013 | |
| WO | WO-2014186823 | A1 * | 11/2014 | E21B 43/243 |
| WO | 2015026239 | | 2/2015 | |
| WO | 2015/034369 | | 3/2015 | |
| WO | 2015075799 | | 3/2015 | |
| WO | 2015105427 | | 7/2015 | |
| WO | 2015/115905 | | 8/2015 | |
| WO | 2016/200269 | | 12/2016 | |
| WO | 2019078728 | | 4/2019 | |
| WO | 2019/097259 | | 5/2019 | |
| WO | WO-2019097259 | A1 * | 5/2019 | E21B 17/22 |

OTHER PUBLICATIONS

International Search Report and the Written Opinion for PCT/NO2021/050059, dated Jun. 29, 2021.

Database WPI, Week 201407, Thomson Scientific, London, GB, AN 2014-B98574.

* cited by examiner

FLUID DIVERTER TOOL, SYSTEM AND METHOD OF DIVERTING A FLUID FLOW IN A WELL

CROSS-REFERENCE TO RELATED APPLICATIONS

This application is the U.S. national stage application of International Application PCT/NO2021/050059, filed Mar. 8, 2021, which international application was published on Sep. 16, 2021, as International Publication WO 2021/182968 in the English language. The International Application claims priority of Norwegian patent application No. 20200284, filed Mar. 9, 2020. The international application and Norwegian application are both incorporated herein by reference, in entirety.

TECHNICAL FIELD

The invention concerns a fluid diverter tool, system and method of diverting a fluid flow in a subterranean well. The well may be any type of well, such as a petroleum well (oil and/or gas well), production well, injection well, water well or hydrothermal well. The well may also be vertical or deviated. The invention may be used in various well operations requiring a fluid flow to be diverted from an interior of a pipe body (e.g. casing or liner) to an exterior annulus in the well via one or more holes (e.g. perforations) formed through a wall of the pipe body. As such, the invention may be used for cleaning, conditioning and/or plugging said annulus of the well.

Advantageously, the present invention may be used in context of plugging and abandoning (P&A) wells using the so-called Perf-Wash-Cement method ("PWC®" and "PWC, Perf-Wash-Cement®"), which is commonly known in the oil and gas industry as a very cost-efficient and environmentally safe method of plugging wells. The invention may also be suitable for other types of plugging operations based on the Perf-Wash-Cement (PWC) method, such as zone isolation, side-tracking or remedial repairs in wells. Further, the invention may be used in context of so-called cut-and-pull operations in wells, the purpose of which is to cut (i.e. sever) and pull out one or more sections of a pipe body from a well. In this case, the invention may be used to wash and clean away, via said holes, pipe-binding contaminants (e.g. particles, debris, deposits, etc.) in the exterior annulus before cutting and pulling out said section(s) of the pipe body.

TECHNICAL BACKGROUND

In well operations requiring a fluid flow to be diverted outwards into an annulus via holes in a pipe body, pressure surges may arise during the well operation. Such pressure surges are likely related to operational parameters, such as pump pressures and fluid densities. The pressure surges may also arise as a result of encountering flow restrictions in a well, for example a zone of hard and wear-resistant annular material, or an unperforated "blank" pipe section. Although less likely, pressure surges may arise as a result of sudden influx of pressurized formation fluids (i.e. a "kick"). Irrespective of their causes, such pressure surges may prove harmful or destructive to the integrity of equipment and tubulars in the well, and also to the integrity of the rocks through which the well extends. All of these surge-related effects are highly undesirable.

Accordingly, there is a need in the industry, including the oil and gas industry, for a simple, cost-efficient and versatile solution for avoiding or at least mitigating the harmful or destructive effects of such pressure surges in context of carrying out fluid diversion operations in a well, including the aforementioned types of operations.

PRIOR ART

Various well plugging technologies based on the noted Perf-Wash-Cement (PWC) method are disclosed in the following patent publications:

WO 2012/096580 A1;
WO 2012/105852 A1;
WO 2013/133719 A1;
WO 2015/026239 A2;
WO 2015/034369 A1;
WO 2015/115905 A1;
WO 2016/200269 A1;
WO 2019/078728 A2; and
WO 2019/097259 A1.

Various fluid diversion technologies used in context of cut-and-pull operations, as mentioned above, are disclosed in the following patent publications:

WO 2011/061506 A2;
WO 2013/133718 A1; and
WO 2015/105427 A2;

None of these publications seek to mitigate the harmful or destructive effects of said pressure surges developed in context of carrying out fluid diversion operations in wells, including the aforementioned types of operations. These publications therefore do not disclose the main features of the present invention.

SUMMARY OF THE INVENTION

The primary object of the invention is to provide a technology for avoiding or at least mitigating the harmful or destructive effects of pressure surges arising in context of diverting a fluid flow outward into an annulus via one or more holes (e.g. perforations) formed in a pipe body in a well.

In view of said primary object, a secondary object of the invention is to ensure complete annular displacement of a treatment fluid when being diverted outwards into said annulus via one or more of said holes during a treatment operation in the well.

Another secondary object of the invention is to achieve minimal mixing of said treatment fluid with other well fluids during the treatment operation.

Another secondary object of the invention is to limit the volume of treatment fluid used during the treatment operation, which saves on fluid costs.

Another secondary object of the invention is to use relatively small hole sizes in the pipe body for said treatment operation. This facilitates use of conventional and cheaper perforation technologies, e.g. perforation guns, for making said one or more holes in the pipe body.

Another secondary object of the invention is to facilitate improved annular displacement of said treatment fluid in a relatively large-sized pipe body and annulus in the well.

Yet another secondary object is to use the present invention in a well having multiple pipe bodies disposed in a pipe-in-pipe configuration so as to define multiple outwardly surrounding and corresponding annuli, the multiple pipe bodies also having a plurality of holes formed through the walls thereof so as to gain access to said annuli.

A further object of the present invention is to provide an alternative variant of the prior art Perf-Wash-Cement (PWC) method mentioned above.

The ultimate object of the invention is therefore to provide a technology capable of optimizing the diversion and displacement of a fluid flow in a controlled and safe manner during one or more treatment operations in a well.

The objects are achieved by virtue of features and steps disclosed in the following description and in the subsequent claims.

In a first aspect, the present invention comprises a fluid diverter tool for use in a pipe body in a well, the diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards. The fluid diverter tool is characterized in that the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element; and wherein the pressure relief device is adapted to close upon exposure to a lower than said first pressure differential acting across the pressure relief device from the second side of the packer element.

When used in said well, the first end of the mandrel would be the shallower and generally upper end thereof, whereas the second end of the mandrel would be the deeper and generally lower end thereof. Similarly, the first side of the packer element would be the shallower and generally upper side thereof, whereas the second side of the packer element would be the deeper and generally lower side thereof.

Further, the pipe body may be a tubular entity in the form of a casing, liner, production tubing, injection tubing or similar disposed in the well.

It is also to be understood that the term "fluid" or "fluidized", as used herein, generally refers to a liquid or a liquefied material or substance.

In one embodiment of the diverter tool, the pressure relief device comprises at least one pressure relief valve disposed within at least one corresponding relief channel extending through the packer element between the first and second sides thereof. A suitable pressure relief valve may be selected and used in this embodiment.

In an alternative embodiment of the diverter tool, the pressure relief device comprises:

at least one relief channel extending through the packer element between the first and second sides thereof; and at least one seal body shaped and operable to sealingly engage and close said relief channel when in a closed seal position, said seal body also operable to move between the closed seal position and a first open seal position at the first side of the packer element so as to allow said relief channel to be closed and opened;

wherein the seal body is biased towards the closed seal position; and wherein said bias of the seal body is adapted to yield upon exposure to said first pressure differential so as to allow the seal body to move towards the first open seal position at the first side of the packer element and relieve pressure from the second side to the first side of the packer element.

In this alternative embodiment, the at least on seal body may be in the form of one or more disc-shaped seal bodies capable of sealing against, or within, one or more relief channels in the packer element. Insofar as the seal body is biased towards the closed seal position, the seal body will therefore experience some resistance against movement towards the first open seal position.

In a first variant of the alternative embodiment, said relief channel comprises a plurality of relief channels extending through the packer element; and wherein said seal body comprises a singular seal body shaped and operable to sealingly engage the plurality of relief channels when in the closed seal position.

In this first variant, the singular seal body may be in the form of a seal disc capable of sealing against a common side of the relief channels so as to allow all relief channels to be closed or opened simultaneously.

In a second variant of the alternative embodiment, said relief channel comprises an annular relief channel located between the mandrel and the packer element and extending longitudinally within the packer element so as to separate the mandrel from the packer element;

wherein support elements extend between the packer element and the mandrel for supporting the packer element on the mandrel;

wherein said seal body comprises an annular seal body slidably disposed on the mandrel for allowing longitudinal movement of the annular seal body between the closed seal position and the first open seal position at the first side of the packer element; and wherein the annular seal body is shaped and operable to sealingly engage the annular relief channel when located therein so as to define the closed seal position of the annular seal body.

In this second variant, the support elements may be in the form of struts (or similar) for allowing bypass of fluids. The closed seal position may also be defined by any position in which the annular seal body sealingly engages the surrounding annular relief channel along its longitudinal extent.

Further to said second variant, the annular seal body may be affixed to a seal sleeve slidably disposed on the mandrel for allowing said longitudinal movement of the annular seal body between the closed seal position and the first open seal position at the first side of the packer element; and wherein the seal sleeve is biased towards the closed seal position, thereby also biasing the annular seal body towards the closed seal position. The bias of the seal body is thus provided indirectly by the biased seal sleeve.

In this context, the diverter tool may also comprise a biasing device disposed on the mandrel and in operable contact with the slidable seal sleeve so as to provide said (indirect) bias of the annular seal body towards the closed seal position. This biasing device may comprise a spring device of suitable type, for example a coil spring or similar.

Yet further to said second variant, the annular seal body may also be operable to move longitudinally between the closed seal position and a second open position at the opposite second side of the packer element so as to allow said relief channel to be opened in the opposite direction. This may facilitate upward movement or withdrawal of the diverter tool from said pipe body by virtue of allowing ambient fluids in the pipe body to flow through the packer element during said movement within the pipe body.

In the latter context, the annular seal body may be operable to move towards the second open position upon exposure to a second pressure differential acting on the annular seal body from the first side of the packer element. The second pressure differential may arise in response to moving the diverter tool upwards through said ambient fluids in the pipe body.

Advantageously, said second pressure differential is lower than said first pressure differential so as to facilitate easy upward movement or withdrawal of the diverter tool from the pipe body.

Additionally, or alternatively, said bias of the annular seal body may be adapted to yield in the opposite direction upon exposure to said second pressure differential so as to allow the annular seal body to move towards the second open position. This implies that said bias of the annular seal body is bidirectional and therefore is responsive to individual pressure differentials acting in opposite directions. As such, the bias is responsive to said first pressure differential when operating the diverter tool in the pipe body, and said bias is also responsive to said second pressure differential when withdrawing or moving the diverter tool upwards in the pipe body.

Further to said alternative embodiment, the diverter tool may comprise a releasable holding mechanism operable to releasably hold said seal body in an open holding position at the first side of the packer element before operating the diverter tool in said pipe body. This feature may facilitate insertion of the diverter tool into said pipe body by virtue of allowing said ambient fluids in the pipe body to flow through the packer element when being moved downwards within the pipe body.

The releasable holding mechanism may comprise one or more retaining elements operable to move radially within corresponding openings in the mandrel from an outer radial position to an inner radial position;

wherein said seal body is adapted to be held in the open holding position by the one or more retaining elements in the outer radial position; and wherein movement of the one or more retaining elements to the inner radial position releases the holding mechanism and allows said seal body to move from the open holding position to the closed seal position.

The releasable holding mechanism may further comprise an activation sleeve located on an interior of the mandrel and slidably disposed therein, said activation sleeve also operable to move longitudinally between a first activation position and a second activation position;

wherein the activation sleeve, when in the first activation position, covers said openings in the mandrel and holds the one or more retaining elements in the outer radial position; and wherein the activation sleeve, when in the second activation position, does not cover said the openings and allows the one or more retaining elements to move to the inner radial position for said release of the holding mechanism.

The one or more retaining elements may be selected from a group comprising retaining dogs and/or retaining balls. Other suitable retaining elements may also be used, as appropriate.

The diverter tool may also comprise a suitable spring device disposed on the mandrel and operable to move said seal body from the open holding position to the closed seal position after release of the holding mechanism. The spring device may also be operable to provide said bias of the seal body towards the closed seal position.

Yet further, the packer element of the diverter tool may comprise a radially extending collar adapted and operable to sealingly engage the inside of said pipe body. As such, the radially extending collar may be a cup-shaped packer, for example a so-called swab cup commonly known in the industry and familiar to the skilled well practitioner. Cup-shaped packers are generally formed from a resilient material, such as rubber or elastomer material, and have a concave side and an opposite convex side. Due to its resiliency, such a packer is usually of a size allowing it to flex and sealingly engage with an inside of the pipe body when forced through the pipe body. Pressurization of the concave side of the packer during operation serves to force the packer outwards so as to seal (even) better against the inside of the pipe body, whereas pressurization of its opposite convex side serves to flex the packer inwards so as to relieve pressure from the convex side to the concave side thereof.

Alternatively, the packer element of the diverter tool may comprise an expandable packer adapted and operable to expand radially to sealingly engage the inside of said pipe body. The expandable packer may be an inflatable packer adapted and operable to expand radially upon inflation thereof. Yet alternatively, the expandable packer may be an axially compressible packer adapted and operable to expand radially upon axial compression thereof. Such expandable packers are known in the art and are generally run into the pipe body in a relaxed and unexpanded state, after which they are activated and expanded in place within the pipe body.

In some advantageous applications, the packer element may also be rotatably connected to the mandrel to allow rotation of the mandrel relative to the packer element. The rotatable connection may comprise a suitable bearing, bushing or gliding arrangement disposed between the mandrel and the packer element.

In a second aspect, the present invention comprises a system for diverting a fluid flow in a well, the system comprising:

at least one pipe body, including an innermost pipe body;

at least one annulus, including an innermost annulus, located between the innermost pipe body and a surrounding borehole wall of the well; and a plurality of holes formed through a wall of said at least one pipe body and dispersed along a longitudinal section of the well to allow communication between the at least pipe body and the at least one annulus. The system is characterized in that it also comprises a fluid diverter tool according to the first aspect of the invention positioned in the innermost pipe body at said longitudinal section of the well;

wherein said second end of the mandrel of the diverter tool is operably connected (directly or indirectly) to a treatment tool adapted and operable to discharge said treatment fluid into the innermost pipe body;

wherein said packer element of the diverter tool is in sealing engagement with an inside of the innermost pipe body to allow, if possible, a flow of the treatment fluid to be diverted outwards into the at least one annulus via one or more of said holes in the at least one pipe body along the longitudinal section, the packer element defining a first pipe region above said first side of the packer element and a second pipe region below said second side of the packer element; and wherein said pressure relief device of the diverter tool is operable to open and relieve pressure from the second pipe region to the first pipe region upon exposure to a fluid pressure in the second pipe region being sufficient to generate said first pressure differential across the pressure relief device.

From this definition, it is clear that the present system employs the fluid diverter tool disclosed in the above first aspect of the invention. All of the above features and comments relating to the fluid diverter tool are therefore applicable to the present system. It is also to be understood that said treatment fluid generally refers to a liquid or a liquefied material or substance suitable for performing a treatment operation in the well.

From this definition, it is also to be understood that the present system may comprise multiple pipe bodies disposed in a pipe-in-pipe configuration in the well so as to define multiple outwardly surrounding and corresponding annuli confined by the surrounding borehole wall. In this context, the innermost pipe body constitutes the smallest pipe size in the pipe-in-pipe configuration. These pipe bodies also have a plurality of holes formed through their respective walls, the holes of which are dispersed along said longitudinal section so as to gain access to the corresponding annuli. In this setting, the packer element would be in sealing engagement with an inside of the innermost pipe body of said pipe-in-pipe configuration and would serve to divert said flow of treatment fluid outwards into the multiple annuli via said holes in the multiple pipe bodies.

To further clarify, said first pipe region is the shallower and generally upper pipe region located above the packer element, whereas said second pipe region is the deeper and generally lower pipe region located below the packer element.

Under normally uninhibited flow conditions in the well, the diverter tool is operable to divert the flow of treatment fluid outwards into the at least one annulus via said one or more holes in the at least one pipe body so as to flow onwards within the at least one annulus to above and past the packer element. Preferably, the treatment fluid then re-enters the innermost pipe body via one or more other holes above the packer element and flows upwards to the surface via the innermost pipe body. Alternatively, although less practical, the treatment fluid could flow upwards to the surface via the one or more annuli above the longitudinal section of the well.

Yet further, the at least one annulus of the system may, or may not, contain various contaminants located along at least a part of said longitudinal section of the well. If present, such contaminants may require removal from the at least one annulus along the longitudinal section. These contaminants may comprise various particles, debris, deposits and/or well fluids, for example filter cake, formation particles, drill cuttings, drilling additives, e.g. barite, cement particles and/or residues, old drilling fluids (or similar) that have settled out or remain in said annulus from previous well operations. Such contaminants may also extend beyond the longitudinal section of the well.

Advantageously, the system may comprise a tubular work string disposed in the innermost pipe body and having a lower end connected to said first end of the mandrel of the diverter tool for operating the diverter tool and the treatment tool in the innermost pipe body, and for supplying the treatment fluid thereto. The work string may, for example, be in the form of a jointed pipe string (e.g. drill string), a coiled tubing string or a coiled hose of suitable type extending to the surface of the well for supplying said treatment fluid to the diverter tool and the treatment tool. Preferably, the treatment fluid is pumped down from the surface of the well.

It is also conceivable for the system to have a suitable downhole pump operably connected (directly or indirectly) to said first end of the mandrel for operating the diverter tool and the treatment tool in the innermost pipe body, and for supplying the treatment fluid thereto. This would require suitable equipment, including power and control devices, connected to the downhole pump for operation and control thereof.

Further, said discharge of treatment fluid into the innermost pipe body may be operable to generate the fluid pressure in the second pipe region being sufficient to open the pressure relief device. In this case, the displacement or pumping of treatment fluid into the second pipe region via the treatment tool may generate sufficient fluid pressure in the second pipe region to open the pressure relief device and relieve pressure from the second pipe region.

Additionally, or alternatively, at least the innermost annulus may include a flow-inhibiting blockage zone located within the longitudinal section of the well;

wherein the packer element is in sealing engagement with the innermost pipe body at the blockage zone of at least the innermost annulus so as to inhibit diversion of the flow of treatment fluid outwards into said annulus via said one or more holes in the at least one pipe body; and wherein said discharge of treatment fluid into the innermost pipe body at the blockage zone is operable to generate the fluid pressure in the second pipe region being sufficient to open the pressure relief device.

In this case, the displacement or pumping of treatment fluid into the second pipe region via the treatment tool is inhibited by said blockage zone so as to increase and generate sufficient fluid pressure in the second pipe region to open the pressure relief device and relieve pressure from the second pipe region.

The flow-inhibiting blockage zone in at least the innermost annulus may comprise very hard, sticky and/or wear-resistant material, for example contaminants of the above-mentioned types, including very firm and hard cement, and/or wear-resistant formations rocks of the surrounding borehole wall. This material may prove sufficiently resistant to remain in the at least one annulus even after attempting to wash and clean away the material from the at least one annulus. It is also to be understood that one or more of these annuli may or may not include several flow-inhibiting blockage zones located within the longitudinal section, each of which may inhibit outward diversion of treatment fluid.

Advantageously, the first pressure differential may be lower than a fluid pressure required in the second pipe region to break down the packer element, i.e. lower than the load capacity or breaking strength of the packer element.

Additionally, or alternatively, the first pressure differential may be lower than a fluid pressure required in the second pipe region to break down the surrounding borehole wall of the well, i.e. lower than the load capacity or breaking strength of the surrounding rocks. A so-called leak-off test (LOT), which is not part of the present invention, is commonly used to determine the fluid pressure required to break down the adjacent rocks of the well.

Further, the treatment tool may comprise a jetting tool adapted and operable to discharge jets of treatment fluid directed outwards into the at least one annulus via said one or more holes in the at least one pipe body. Such a jetting tool is disclosed in, for example, WO 2013/133719 A1, WO 2015/034369 A1 and WO 2016/200269 A1, which are mentioned under "Prior art" above. Use of such jets allow the treatment fluid to gain better access to various places and voids in the at least one annulus so as to facilitate the overall treatment operation and achieve an optimum treatment effect in the at least one annulus.

Optionally, the jetting tool may include a check valve adapted and operable to open upon exposure to a predetermined fluid pressure and discharge said jets of treatment fluid.

Such a check valve is particularly useful in context of supplying a treatment fluid of relatively high density (e.g. cement slurry) as compared to ambient fluids in the well (e.g. drilling mud or a completion fluid, such as water or brine). The check valve may prove instrumental in preventing so-called U-tubing (oscillatory movement of a fluid column) when displacing such a high-density treatment fluid into the well. This prevention serves to avoid or reduce any mixing of the treatment fluid with the ambient fluids so as to contaminate the treatment fluid. The check valve may thus be adapted to open at a predetermined pump pressure and then to close when the pumping (and associated pump pressure) ceases.

It is also conceivable for the system to include a first jetting tool not equipped with a check valve and a second jetting tool equipped with a check valve. As such, the first jetting tool may be used in a first operation for jetting a first treatment fluid of relatively low density, for example a drilling mud or a spacer fluid. The second jetting tool may then be used in a second and subsequent operation for jetting a second treatment fluid of relatively high density, for example cement slurry.

Additionally, or alternatively, the treatment tool may comprise an open-ended pipe section adapted and operable to discharge the treatment fluid directly into the innermost pipe body. The open-ended pipe section may, for example, be a so-called "stinger" (e.g. a "cement stinger").

Yet further, the treatment fluid may be a fluid selected from a group comprising:

- a washing fluid for cleaning in the at least one annulus;
- a spacer fluid for conditioning surfaces defining the at least one annulus; and
- a fluidized plugging material for forming a plug in the at least one annulus and the at least one pipe body along at least the longitudinal section of the well.

The washing fluid may be drilling mud, brine or water or some other fluid suitable for the particular treatment operation. The spacer fluid, as commonly known and referred to in the art, is typically used for conditioning the surfaces of a pipe body and an annulus, for example for removing mud and/or contaminants from these surfaces. The spacer fluid may also have water-wetting properties or similar for conditioning these surfaces, including the rock surface of the surrounding borehole wall, so as to facilitate improved bonding with a subsequent plugging material introduced therein. In this context, the spacer fluid also acts as a "spacer" between the plugging material and a preceding washing fluid or ambient fluids in the well. Further, the fluidized plugging material is typically comprised of cement slurry but may be comprised of any suitable plugging material, for example some type of resin or similar material.

It is therefore to be understood that the present system also may be used in a cut-and-pull operation to wash and clean away, via said holes, pipe-binding contaminants located in an annulus, and along a section of a pipe body, before cutting and pulling out the liberated pipe section from the well, as discussed above.

It is also to be understood that the present system may employ one type of treatment fluid in one type of treatment operation, whereas some other type of treatment fluid may be employed in another type of treatment operation in the well. Further, it is to be understood that variations of the system may be used for various consecutive treatment operations in the well. This implies that one type of treatment fluid and/or treatment tool may be employed in one treatment operation, whereas one or more other types of treatment fluid and/or treatment tools may be employed in one or more subsequent treatment operations in the well. Yet further, it is to be understood that multiple treatment operations may be carried out in a single run or in multiple runs into the well, as deemed practicable, desirable or possible.

In a third aspect, the present invention comprises a method of diverting a fluid flow in a well, the well comprising:

- at least one pipe body, including an innermost pipe body;
- at least one annulus, including an innermost annulus, located between the innermost pipe body and a surrounding borehole wall of the well;
- a plurality of holes formed through a wall of said at least one pipe body and dispersed along a longitudinal section of the well to allow communication between the at least pipe body and the at least one annulus. The method is characterized in that it comprises the steps of:
- (A) using a fluid diverter tool according to the first aspect of the invention and operably connecting (directly or indirectly) said second end of the mandrel of the diverter tool to a treatment tool adapted and operable to allow discharge of said treatment fluid;
- (B) positioning the diverter tool and the treatment tool in the innermost pipe body at said longitudinal section of the well;
- (C) sealingly engage said packer element of the diverter tool with an inside of the innermost pipe body so as to define a first pipe region above said first side of the packer element and a second pipe region below said second side of the packer element;
- (D) displacing the treatment fluid through the diverter tool and the treatment tool so as to discharge into the second pipe region of the innermost pipe body and, if possible, allowing said packer element of the diverter tool to divert a flow of the treatment fluid outwards into the at least one annulus via one or more of said holes in the at least one pipe body along the longitudinal section; and
- (E) allowing said pressure relief device of the diverter tool to open and relieve pressure from the second pipe region to the first pipe region of the innermost pipe body upon exposure to a fluid pressure in the second pipe region being sufficient to generate said first pressure differential across the pressure relief device.

From this definition, it is clear that the present method employs the fluid diverter tool disclosed in the first aspect of the invention and the system disclosed in the second aspect thereof. All of the above features and comments relating to the fluid diverter tool and the system are therefore applicable to the present method. It is also to be understood that said treatment fluid generally refers to a liquid or a liquefied material or substance suitable for performing a treatment operation in the well.

Advantageously, the present method may comprise connecting said first end of the mandrel to a lower end of a tubular work string for operating the diverter tool and the treatment tool in the innermost pipe body, and for supplying the treatment fluid thereto. Preferably, step (D) involves pumping the treatment fluid down from the surface of the well.

The method may further comprise moving the diverter tool and the treatment tool along the longitudinal section whilst displacing the treatment fluid in step (D). The direction of movement within the innermost pipe body may depend on the type of treatment operation carried out and may also involve repeating the movement along all or part(s) of the longitudinal section during a treatment operation. As such, the treatment operation may be initiated by moving the diverter tool and treatment tool downwards and then upwards or, alternatively, upwards and then downwards, one or more times (passes) during the treatment operation.

The method may further comprise rotating the treatment tool whilst displacing the treatment fluid in step (D). This may further facilitate displacement of the treatment fluid within the innermost pipe body and into, and within, the at least one annulus so as to improve the overall treatment result. Such rotation may also prevent certain types of treatment fluid (e.g. cement slurry) and/or dislodged particles/residues (e.g. contaminants in the at least one annulus) from sticking or bonding to associated well equipment/parts and thus jeopardizing the treatment operation.

Yet further, the displacing of treatment fluid in step (D) may operate to increase the fluid pressure in the second pipe region sufficiently to generate the first pressure differential and thus open the pressure relief device in step (E).

Additionally, or alternatively, step (D) may comprise displacing the treatment fluid into the second pipe region at a location wherein at least the innermost annulus includes a flow-inhibiting blockage zone within the longitudinal section of the well, said blockage zone inhibiting diversion of the flow of treatment fluid outwards into said annulus via one or more of said holes in the at least one pipe body; and wherein the displacing of treatment fluid at the blockage zone operates to increase the fluid pressure in the second pipe region sufficiently to generate the first pressure differential and thus open the pressure relief device in step (E).

As noted above, the flow-inhibiting blockage zone(s) in the at least one annulus may comprise very hard, sticky and/or wear-resistant material, which may be sufficiently resistant to remain in the one or more annuli even after attempting first to clean away the material from said annulus (see further comments above).

Advantageously, the method may comprise setting the first pressure differential lower than a fluid pressure required in the second pipe region to break down the packer element (see further comments above).

Additionally, or alternatively, the method may comprise setting the first pressure differential lower than a fluid pressure required in the second pipe region to break down (the rocks of) the surrounding borehole wall of the well (see further comments above).

In the method, the treatment tool may comprise a jetting tool adapted and operable to discharge jets of treatment fluid from the jetting tool; and wherein step (D) comprises directing said jets of treatment fluid outwards into the at least one annulus via one or more of said holes in the at least one pipe body (see further comments above).

Optionally, the jetting tool may include a check valve adapted and operable to open at a predetermined fluid pressure; and wherein step (D) comprises allowing the check valve to open upon exposure to the predetermined fluid pressure so as to discharge said jets of treatment fluid from the jetting tool (see further comments above).

Additionally, or alternatively, the treatment tool may comprise an open-ended pipe section; and wherein step (D) comprises discharging the treatment fluid directly into the second pipe region of the innermost pipe body via the open-ended pipe section (see further comments above).

Yet further in the method, the treatment fluid may be a fluid selected from a group comprising:

a washing fluid for cleaning in the at least one annulus;

a spacer fluid for conditioning surfaces defining the at least one annulus; and a fluidized plugging material for forming a plug in the at least one annulus and the at least one pipe body along at least the longitudinal section of the well (see further comments above).

Thus, it is to be understood that the present method also may be used to wash and clean away annular contaminants in context of a cut-and-pull operation, as discussed above.

More specifically, the present method may comprise using the method in an operation for cleaning in the at least one annulus along the longitudinal section;

wherein the treatment fluid is a washing fluid;

wherein the treatment tool comprises a jetting tool adapted and operable to discharge jets of washing fluid from the jetting tool; and wherein step (D) comprises directing said jets of washing fluid outwards into the at least one annulus via one or more of said holes in the at least one pipe body so as to facilitate cleaning in the at least one annulus (see further comments above).

In this context, the present method may also comprise using the present method in a subsequent operation for conditioning surfaces defining the at least one annulus along the longitudinal section;

wherein the treatment fluid is a spacer fluid;

wherein the treatment tool comprises a jetting tool adapted and operable to discharge jets of spacer fluid from the jetting tool; and wherein step (D) comprises directing said jets of spacer fluid outwards into the at least one annulus via one or more of said holes in the at least one pipe body so as to facilitate conditioning of said surfaces of the at least one annulus (see further comments above).

Additionally, or alternatively, the present method may comprise using the method in an operation for forming a plug in the at least one annulus and the at least one pipe body along at least the longitudinal section of the well;

wherein the treatment fluid is a fluidized plugging material;

wherein the treatment tool comprises a jetting tool adapted and operable to discharge jets of fluidized plugging material from the jetting tool; and wherein step (D) comprises directing said jets of fluidized plugging material outwards into the at least one annulus via one or more of said holes in the at least one pipe body so as to facilitate said plugging of the well (see further comments above).

It is to be understood that this plugging operation may be a singular operation or, alternatively, an integral part of a sequence of treatment operations in the well. Such a sequence may involve an initial cleaning operation, an optional and intermittent conditioning operation, and a final plugging operation, as discussed above, thereby defining yet another variant of said Perf-Wash-Cement (PWC) method.

In context of this latter plugging operation, the jetting tool may include a check valve adapted and operable to open at a predetermined fluid pressure; and wherein step (D) comprises allowing the check valve to open upon exposure to the predetermined fluid pressure so as to discharge said jets of fluidized plugging material from the jetting tool.

As noted above, the check valve may prove instrumental in preventing so-called U-tubing when displacing, for example, a high-density cement slurry into the well. The prevention of U-tubing serves to avoid or reduce mixing of said cement slurry with ambient well fluids (e.g. drilling mud) so as to contaminate the cement slurry, which potentially may result in an inferior cement plug in the well. The check valve may thus be adapted to open at a predetermined pump pressure and then to close when the pumping (and associated pump pressure) ceases.

Alternatively to the preceding plugging with a jetting tool, the present method may comprise using the method in an operation for forming a plug in the at least one annulus and the at least one pipe body along at least the longitudinal section of the well;

wherein the treatment fluid is a fluidized plugging material;

wherein the treatment tool comprises an open-ended pipe section (e.g. a "stinger", such as a cement stinger); and wherein step (D) comprises discharging the fluidized plugging material directly into the second pipe region of the innermost pipe body via the open-ended pipe section, and allowing the packer element to divert the fluidized plugging material into the at least on annulus via one or more of said holes in the at least one pipe body so as to facilitate said plugging of the well (see further comments above).

When using said open-ended pipe section, it is also to be understood that this particular plugging operation may be a singular operation or, alternatively, an integral part of a sequence of treatment operations in the well so as to potentially define yet another variant of the Perf-Wash-Cement (PWC) method, as discussed above.

These various aspects, embodiments and variants disclosed above show that the present invention provides a technology capable of optimizing the diversion and displacement of a fluid flow in a controlled and safe manner during one or more (singular or consecutive) treatment operations in a well. The efficient containment and displacement of treatment fluid afforded by the present invention therefore serve to meet the objects of the invention.

BRIEF DESCRIPTION OF THE DRAWINGS

An exemplary embodiment of the invention is described and depicted in the accompanying drawings, where:

FIGS. 1-8 show schematic representations of steps and features of the present system and a method, whereas FIGS. 9-17 show further details, tools and equipment associated with the present fluid diverter tool. FIGS. 1-17 and their associated descriptions below are useful for the understanding of the invention.

DETAILED DESCRIPTION OF AN EMBODIMENT OF THE INVENTION

Figure 1:
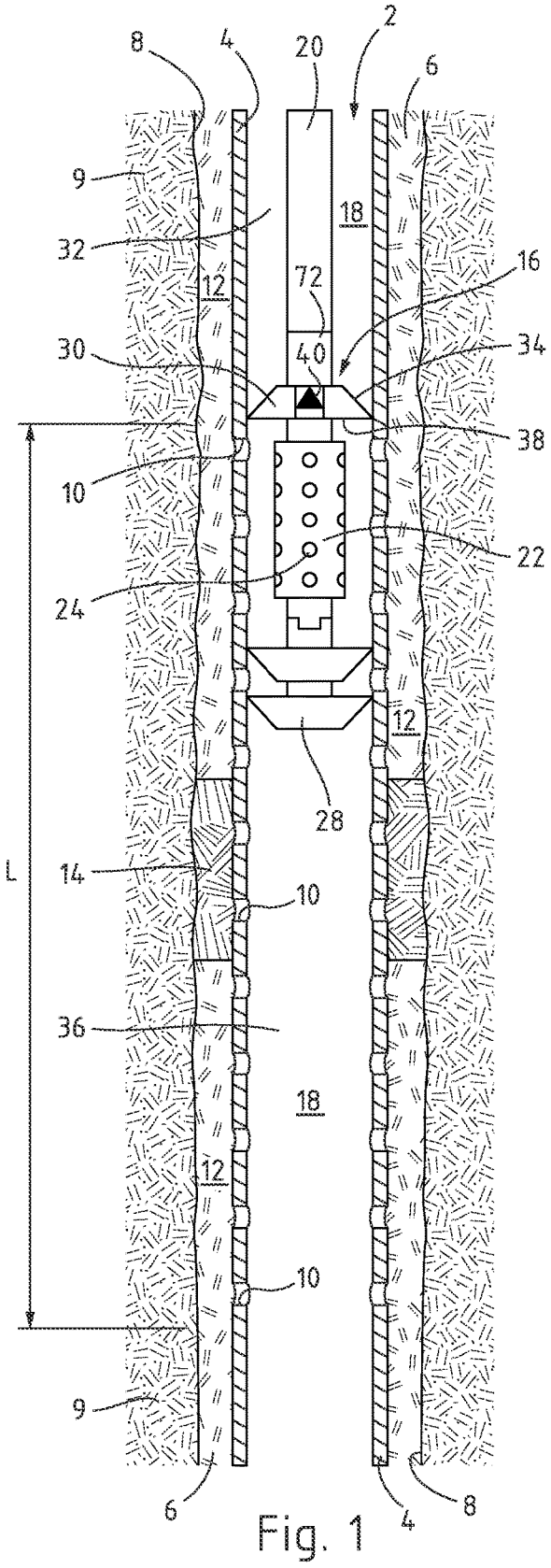
FIGS. 1-8 show a side view of a well to be plugged using a fluid diverter tool, system and method according to the present invention.

FIG. 1 shows an embodiment of a system and method according to the invention for diverting a fluid flow in a well 2. The system comprises a pipe body 4 (e.g. a casing or similar) disposed in the well 2, and an annulus 6 located between the pipe body 4 and a surrounding borehole wall 8 defined by formation rocks 9. A plurality of perforations 10 are formed through a wall of the pipe body 4 and are dispersed along a longitudinal section L of the well 2 so as to allow communication between the pipe body 4 and the surrounding annulus 6. In this embodiment, the perforations 10 are of relatively small hole size and have been formed using a conventional perforation gun. The annulus 6 contains contaminants 12 to be removed therefrom and an intermediate and flow-inhibiting blockage zone 14 comprising very hard and wear-resistant cement located within the longitudinal section L.

The system also comprises a fluid diverter tool 16 according to the invention shown positioned at an upper part of the longitudinal section L, and within an ambient fluid 18 in the pipe body 4, before being activated for operation therein. An upper end of the diverter tool 16 is connected to a lower end of a tubular work string 20 disposed in the pipe body 4 and extending to the surface of the well 2 for operating the diverter tool 16 and for pumping down a suitable treatment fluid thereto. A lower end of the diverter tool 16 is operably connected to a first jetting tool 22 for carrying out a cleaning operation in the annulus 6 along the longitudinal section L. The first jetting tool 22 is provided with a plurality of outwardly directed nozzles 24 for discharging jets of a washing fluid 26 when pumped down thereto via the diverter tool 16 and said tubular work string 20. A releasable plug base 28, in the form of a set of adjoining swab cups, is also releasably connected to, and below, the first jetting tool 22.

Further, the diverter tool 16 comprises a packer element 30, in the form of a single swab cup, in sealing engagement with an inside of the pipe body 4 so as to allow, if possible, a flow of said washing fluid 26 to be diverted outwards into the annulus 6 via one or more of said perforations 10 in the pipe body 4. The swab cup 30 defines a first pipe region 32 located above a first (convex) side 34 of the swab cup 30 and a second pipe region 36 located below a second (concave) side 38 thereof. The swab cup 30 also includes a pressure relief device 40 in an activated state and operable to open and relieve pressure (and fluid flow) from the second pipe region 36 to the first pipe region 32 upon exposure to a fluid pressure in the second pipe region 36 being sufficient to generate a given first pressure differential acting across the pressure relief device 40.

Figure 2:
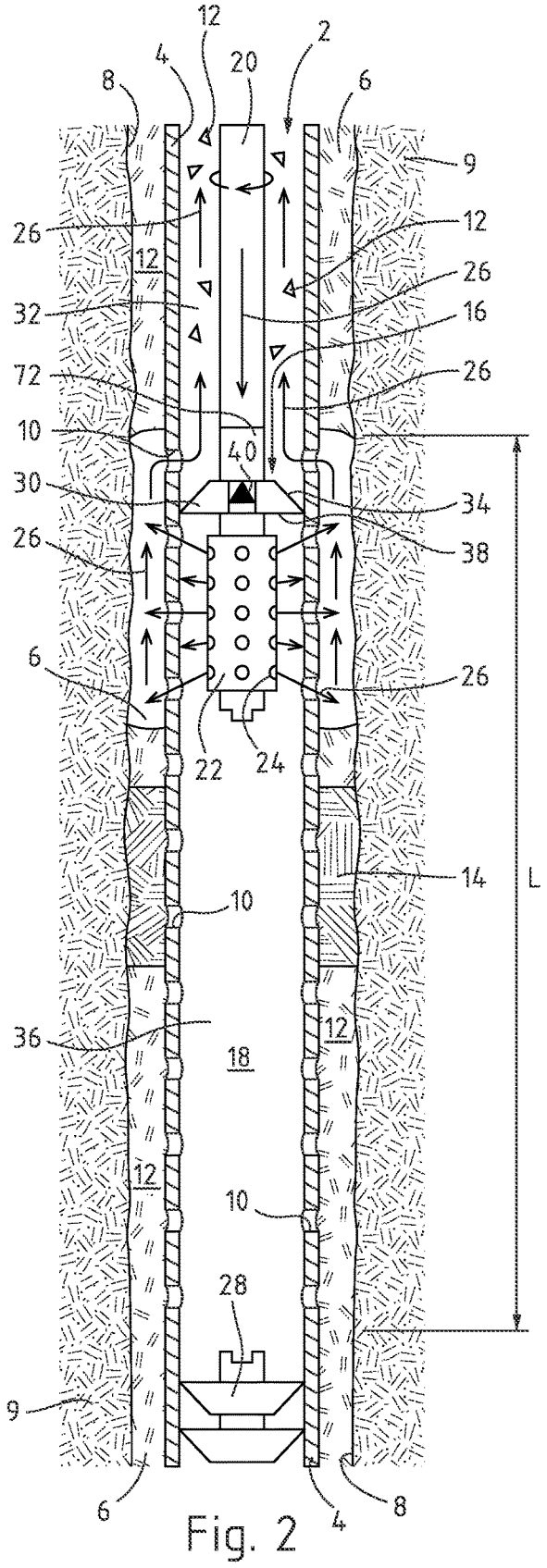

FIG. 2 shows the first jetting tool 22 in operation after initially having disconnected said releasable plug base 28 from the first jetting tool 22 and positioned it below the lowermost perforations 10 along the longitudinal section L. In this released position, the plug base 28 forms a platform below said longitudinal section L for supporting a plugging material (e.g. cement slurry) to be introduced in the well 2 at a later stage, as discussed below. FIG. 2 also shows the first jetting tool 22 after subsequently being lifted up and positioned at perforations 10 along an upper part of the longitudinal section L, and whilst discharging jets of washing fluid 26 outwards into the annulus 6 via perforations 10 in the pipe body 4. The jetting action dislodges and removes contaminants 12 located in an upper part of the annulus 6. During this cleaning operation, the diverter tool 16 diverts washing fluid 26 (and potential contaminants 12) outwards into the annulus 6 via one or more perforations 10 in vicinity of the swab cup 30. Due to the efficient fluid diversion afforded by the diverter tool 16, it is possible to obtain efficient fluid flow and displacement through said relatively small sized perforations 10, which facilitates use of a conventional (and cheaper) perforation gun for making said perforations 10 in the pipe body 4.

During the cleaning operation, the tubular work string 20 and the first jetting tool 22 are rotated and moved slowly downwards whilst pumping washing fluid 26 down and out through the first jetting tool 22 (as described above) so as to progressively wash and clean the annulus 6 along the entire longitudinal section L. Rotation is indicated with a curved arrow on the tubular work string 20. As the first jetting tool 22 and the diverter tool 16 move downwards during operation, dislodged contaminants 12 and washing fluid 26 are forced outwards and upwards via the annulus 6 and past the swab cup 30. This contaminant-laden fluid flow then re-enters the pipe body 4 via perforations 10 above the swab cup 30 and flows onwards to the surface of the well 2. The flow direction of washing fluid 26 (and dislodged contaminants 12) is shown with downstream-directed arrows in FIG. 2.

Figure 3:
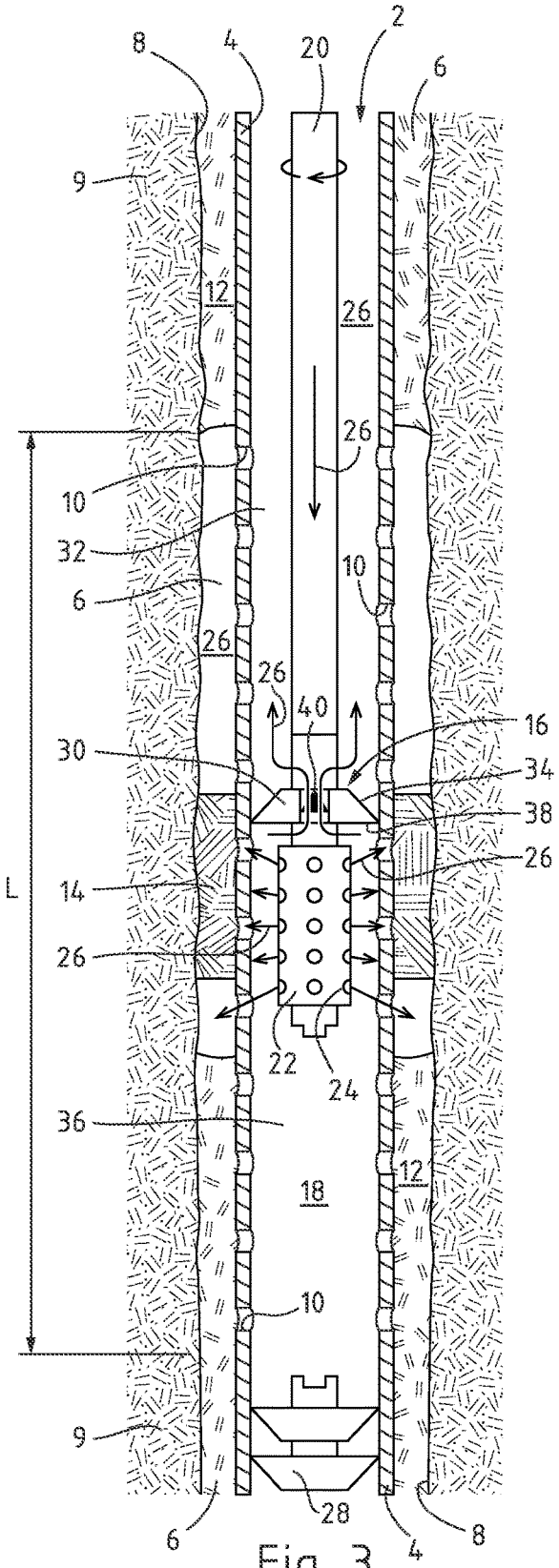

FIG. 3 shows the swab cup 30 of the diverter tool 16 positioned at said flow-inhibiting blockage zone 14 in the annulus 6. The blockage zone 14 inhibits diversion of the flow of washing fluid 26 outwards into the annulus 6 via one or more of said perforations 10 in vicinity of the swab cup 30. The lack of flow diversion at the blockage zone 14 operates to increase the fluid pressure in the second pipe region 36 (below the swab cup 30) sufficiently to generate said first pressure differential across said pressure relief device 40. This opens the pressure relief device 40 and relieves pressure (and fluid flow) from the second pipe region 36 to the first pipe region 32 of the pipe body 4. The relief direction through the relief device 40 is shown with downstream-directed arrows in FIG. 3.

Figure 4:
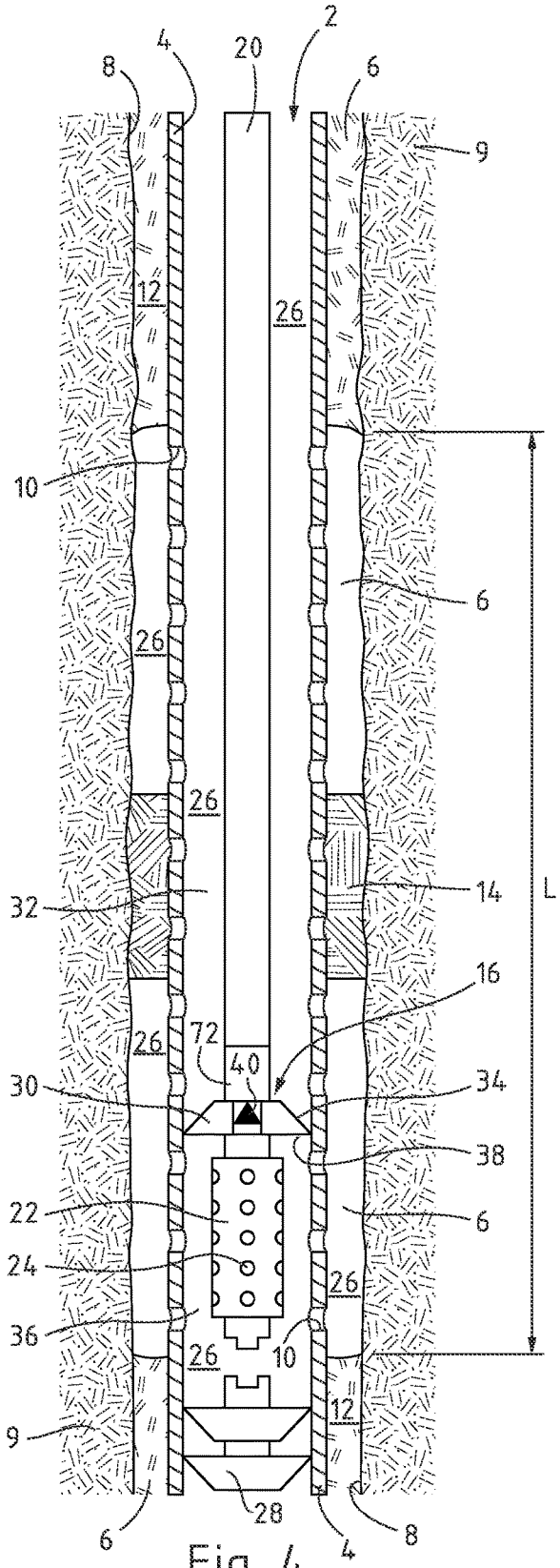

FIG. 4 shows the first jetting tool 22 and the diverter tool 16 positioned at the lowermost perforations 10 along said longitudinal section L, and after having completed the downward cleaning operation in the annulus 6. If desirable, the first jetting tool 22 and the diverter tool 16 may then be moved upwards to carry out an upwards washing pass along the longitudinal section L. The first jetting tool 22 and the diverter tool 16 may also be moved downwards and then upwards or, alternatively, upwards and then downward, one or more times (passes) during a cleaning operation.

Upon engaging said flow-inhibiting blockage zone 14 for each such washing pass and thus increasing the fluid pressure in the second pipe region 36, the pressure relief device 40 will operate to relieve this pressure (and a corresponding fluid flow) when said first pressure differential is reached, as described above.

Although not shown herein, the first jetting tool 22 and diverter tool 16 may optionally be used in a subsequent operation for conditioning surfaces defining the annulus 6 along the longitudinal section L. As such, the first jetting tool 22 may be positioned at the lowermost perforations 10 along the longitudinal section L. A so-called spacer fluid is then pumped down and out through the first jetting tool 22 so as to discharge into the pipe body 4 as jets of spacer fluid directed further outwards into the annulus 6 via one or more perforations 10 at a lower part of the longitudinal section L. During the conditioning operation, the tubular work string 20 and the first jetting tool 22 are rotated and moved upwards whilst pumping spacer fluid down and out through the first jetting tool 22 (as described above) so as to progressively condition the surfaces of the annulus 6 along the entire longitudinal section L. Upon engaging said flow-inhibiting blockage zone 14 and thus increasing the fluid pressure in the second pipe region 36, the pressure relief device 40 will again operate to relieve the increased fluid pressure, as described above. Similar to that of the cleaning operation, various directions of tool movement may be employed in the conditioning operation, as desirable.

Figure 5:
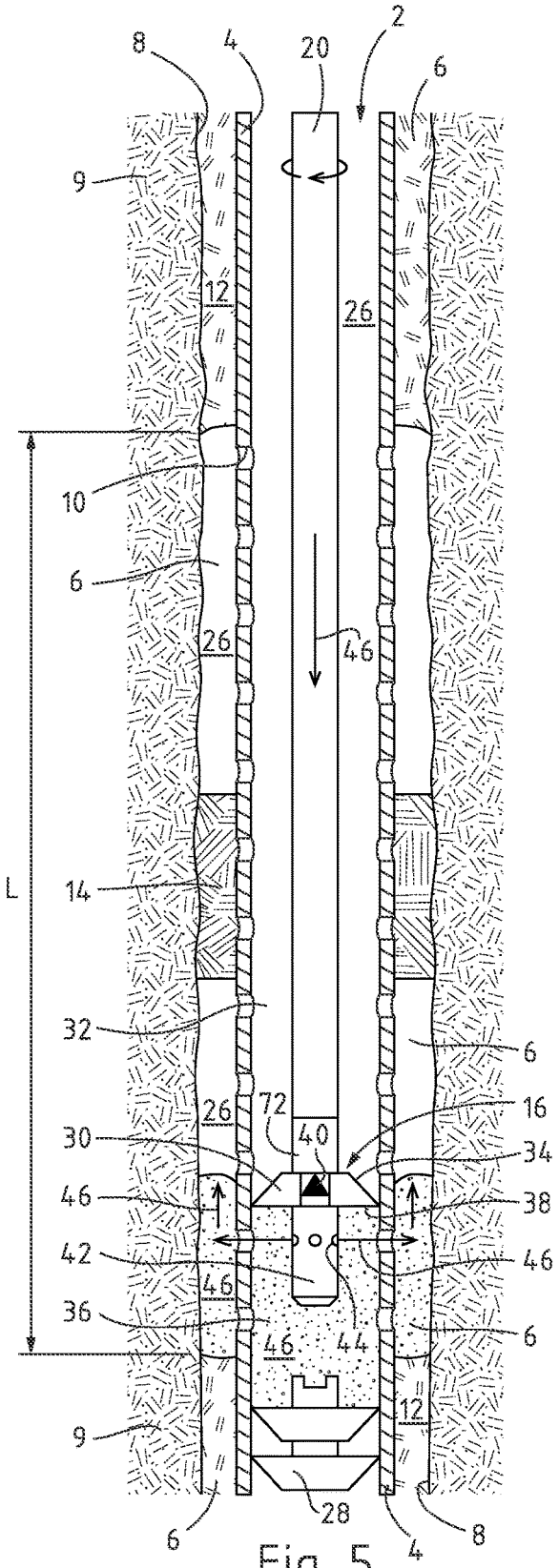

FIG. 5 shows the fluid diverter tool 16 having its lower end operably connected to a second jetting tool 42 for carrying out a separate and subsequent plugging operation in the annulus 6, and along the longitudinal section L. Similar to the first jetting tool 22, the second jetting tool 42 is provided with several outwardly directed nozzles 44 for discharging jets of a fluidized plugging material 46, in the form of cement slurry, via the diverter tool 16 and said tubular work string 20 when pumped thereto. The second jetting tool 42 also includes a check valve arrangement, both of which are discussed in further detail below. The purpose of the plugging operation is to pump and jet cement slurry 46 into both the pipe body 4 and the previously cleaned (and conditioned) annulus 6 along at least the longitudinal section L so as to form a cross-sectional cement plug 46' in the well 2 (see FIG. 7). Considering a generally higher fluid density of the cement slurry 46 and a generally higher fluid pressure used during the plugging operation, the diverter tool 16 used in the plugging operation may be scaled and modified somewhat relative to that of the diverter tool used in the preceding cleaning (and optional conditioning) operation. The general principles of the present diverter tool 16 and its embodiments, as disclosed herein, nevertheless apply for all of these operations.

FIG. 5 also shows the second jetting tool 42 and the diverter tool 16 positioned at the lowermost perforations 10 along said longitudinal section L, and after having initiated the plugging operation. The second jetting tool 42 is discharging jets of cement slurry 46 into the pipe body 4 and further outwards into the annulus 6 via one or more of said perforations 10 in the pipe body 4. The jetting action ensures better access and displacement of cement slurry 46 into various places and voids in the annulus 6. Simultaneously, the swab cup 30 of the diverter tool 16 facilitates the displacement of cement slurry 46 by re-directing and forcing the cement slurry 46 outwards into the annulus 6 via one or more of said perforations 10 during the plugging operation. The swab cup 30 also prevents cement slurry 46 from rising upwards within the pipe body 4 and mixing with said ambient fluid 18 therein (and possible other ambient well fluids) so as to contaminate the cement slurry 46. This ensures minimal mixing of cement slurry 46 with ambient fluids in the well 2 during the plugging operation. The fluid diversion afforded by the swab cup 30 also limits the volume of cement slurry 46 used during the plugging operation so as to save on cement costs. These advantageous effects (minimal mixing, limited fluid volume, reduced fluid costs) contribute to optimize the overall plugging operation. These advantageous effects also apply to any preceding conditioning operation and/or cleaning operation, as described above, and are thus in line with the objects of the invention.

Further, the tubular work string 20 and the second jetting tool 42 are rotated and moved slowly upwards during the plugging operation whilst pumping cement slurry 46 down and out through the second jetting tool 42 (as described above) so as to progressively fill both the pipe body 4 and the annulus 6 along the entire longitudinal section L. Rotation is indicated with a curved arrow on the tubular work string 20. The pump rate and movement speed upwards are generally attuned relative to one another so as to ensure that the fill rate of cement slurry 46 follows the movement of the swab cup 30 during the plugging operation. Should the fill rate of cement slurry 46 exceed said movement speed so as to place a column of cement slurry 46 on top of the swab cup 30, the column of cement slurry 46 may generate a sufficiently high (second) pressure differential across the pressure relief device 40 for it to open and relieve pressure (and flow of cement slurry 46) from the (upper) first pipe region 32 to the second pipe region 36 below the swab cup 30. This mode of operation and pressure relief is also discussed below in context of FIG. 17.

Figure 6:
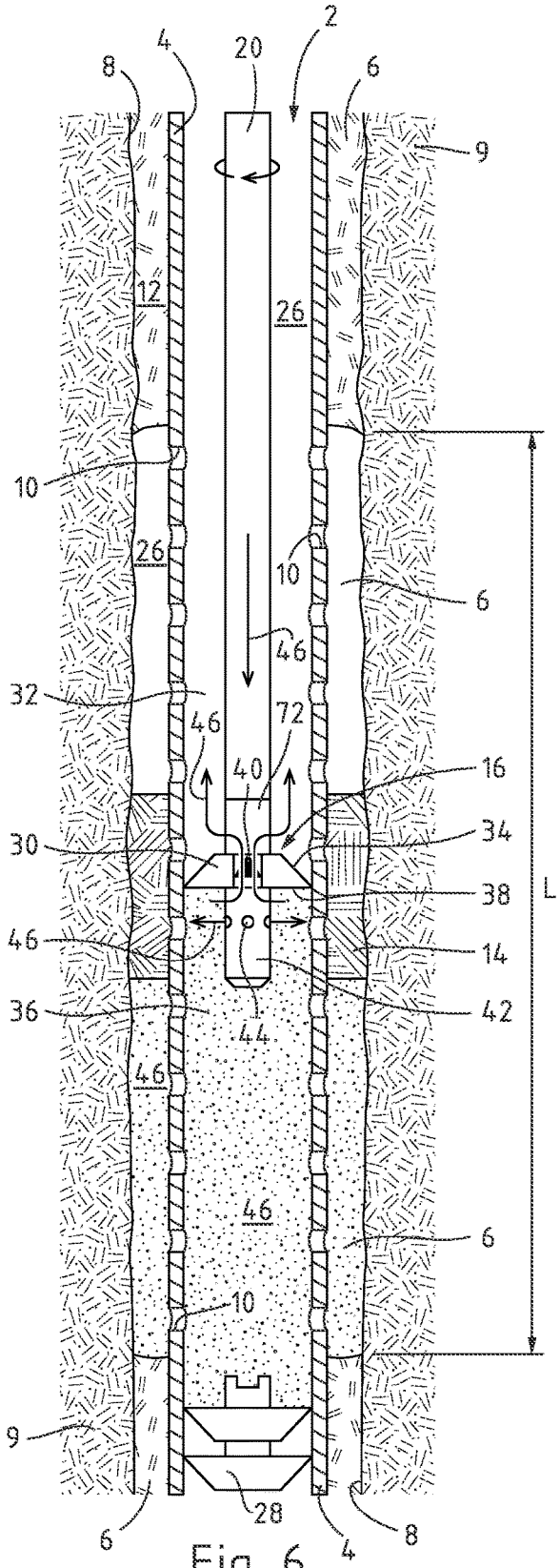

FIG. 6 shows the swab cup 30 of the diverter tool 16 positioned at said flow-inhibiting blockage zone 14 in the annulus 6. Also in this case, the lack of flow diversion at the blockage zone 14 operates to increase the fluid pressure in the second pipe region 36 (below the swab cup 30) sufficiently to generate said first pressure differential across said pressure relief device 40. This opens the pressure relief device 40 and relieves pressure (and fluid flow) from the second pipe region 36 to the first pipe region 32 of the pipe body 4, as discussed above. The relief direction through the relief device 40 is shown with downstream-directed arrows in FIG. 6.

Figure 7:
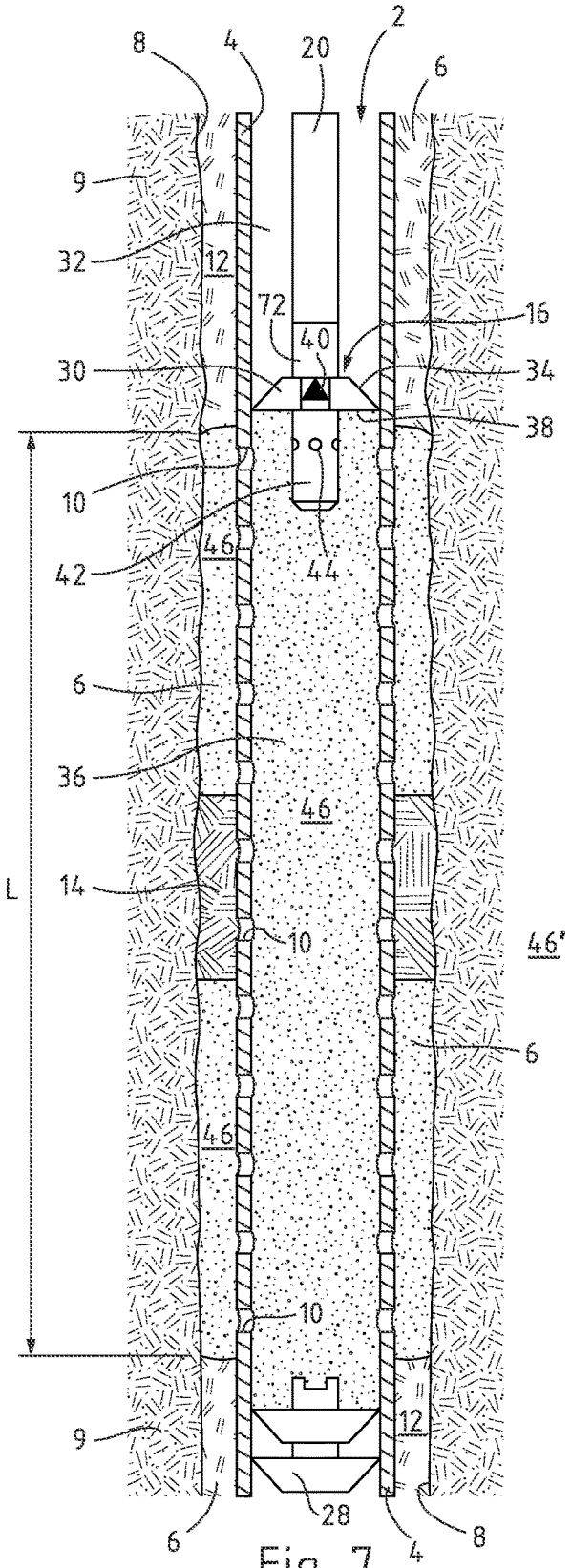

FIG. 7 shows the diverter tool 16 and the second jetting tool 42 positioned at the uppermost perforations 10 along the longitudinal section L, and after having completed the plugging operation. Should the plugging operation be completed some distance above the uppermost perforations 10 (i.e. in any unperforated "blank" pipe section) so as to prevent the cement slurry 46 from flowing outwards, which is not shown herein, the fluid pressure in the second pipe region 36 would again increase sufficiently to open said pressure relief device 40 and thus relieve pressure (and fluid flow) from the second pipe region 36 to the first pipe region 32, as described above.

Figure 8:
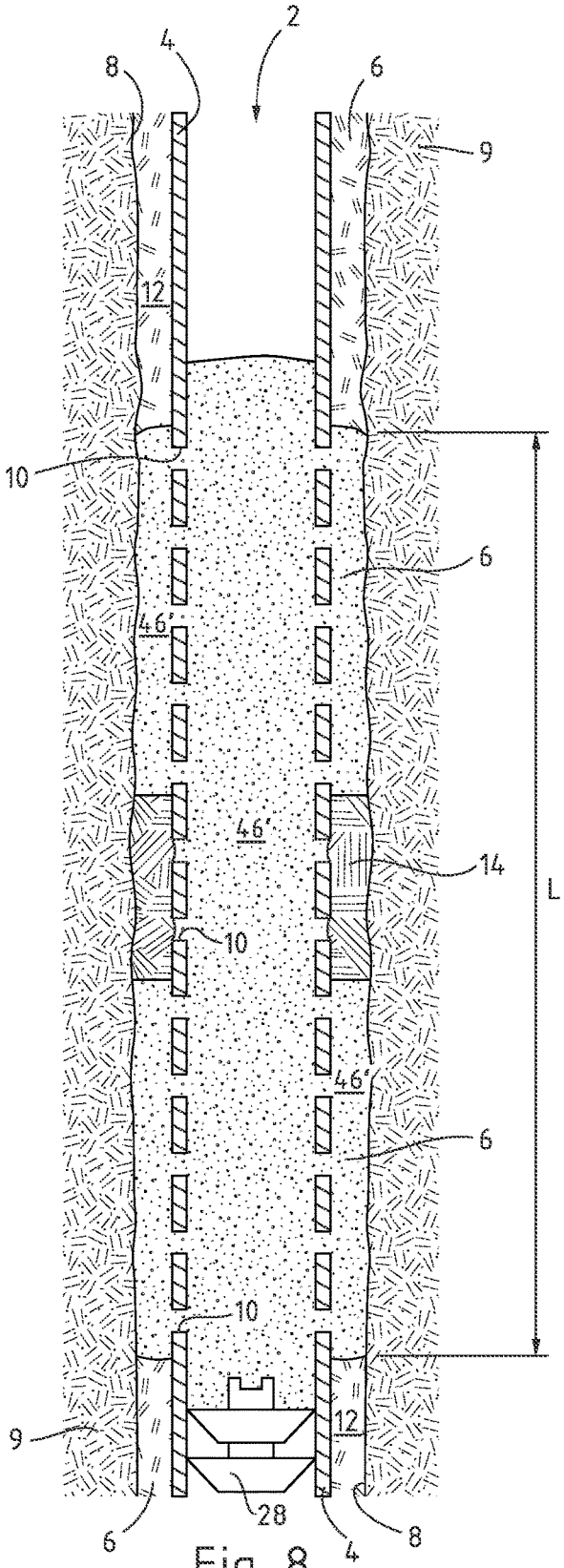

FIG. 8 shows the well 2 after having removed the diverter tool 16 and the second jetting tool 42 from the well 2, and after having allowed the cement slurry 46 to harden in the pipe body 4 and in the surrounding annulus 6 so as to form a cross-sectional cement plug 46' along the entire longitudinal section L of the well 2.

From the above, it is evident that this particular embodiment of the invention describes use of the diverter tool 16 in two separate runs into the well 2. In the first run, the diverter tool 16 is operably connected to the first jetting tool 22 for carrying out said cleaning (and optional conditioning) operation in the well 2. In the second run, the diverter tool 16 is operably connected to the second jetting tool 42 for carrying out said plugging operation in the well 2.

In another embodiment not shown herein, the first and second jetting tools 22, 42 may be operably connected, one above the other, for carrying out consecutive and corresponding operations during the same run into the well 2. Various ball-drop (or similar) activation mechanisms, as known in the art, may be used to activate each respective jetting tool 22, 42 for each consecutive operation in the well 2. The second jetting tool 42 for displacing said cement slurry 46 may thus be connected directly below the diverter tool 16, whereas the first jetting tool 22 (or some other suitable washing tool) for displacing said washing fluid 26 may be connected directly below the second jetting tool 42. When running into the pipe body 4 and subsequently activating the lowermost second jetting tool 42 (for said cleaning operation), the pressure relief device 40 of the diverter tool 16 may be kept in an open and inactivate position using, for example, a releasable holding mechanism arranged above said first side 34 of the swab cup 30, as discussed below and shown in FIGS. 9-13. The flow of washing fluid 26 (and removed contaminants 12) may thus flow via both the annulus 6 (as discussed above) and the open pressure relief device 40 during the entire cleaning operation. The subsequent plugging operation is initiated (during the same run into the well 2) by activating both the uppermost first jetting tool 22 and the pressure relief device 40, as discussed below and shown in FIG. 14. The plugging operation then proceeds as discussed above and shown in FIGS. 5-7.

Figure 11:
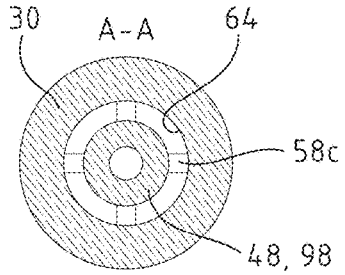
Figure 10:
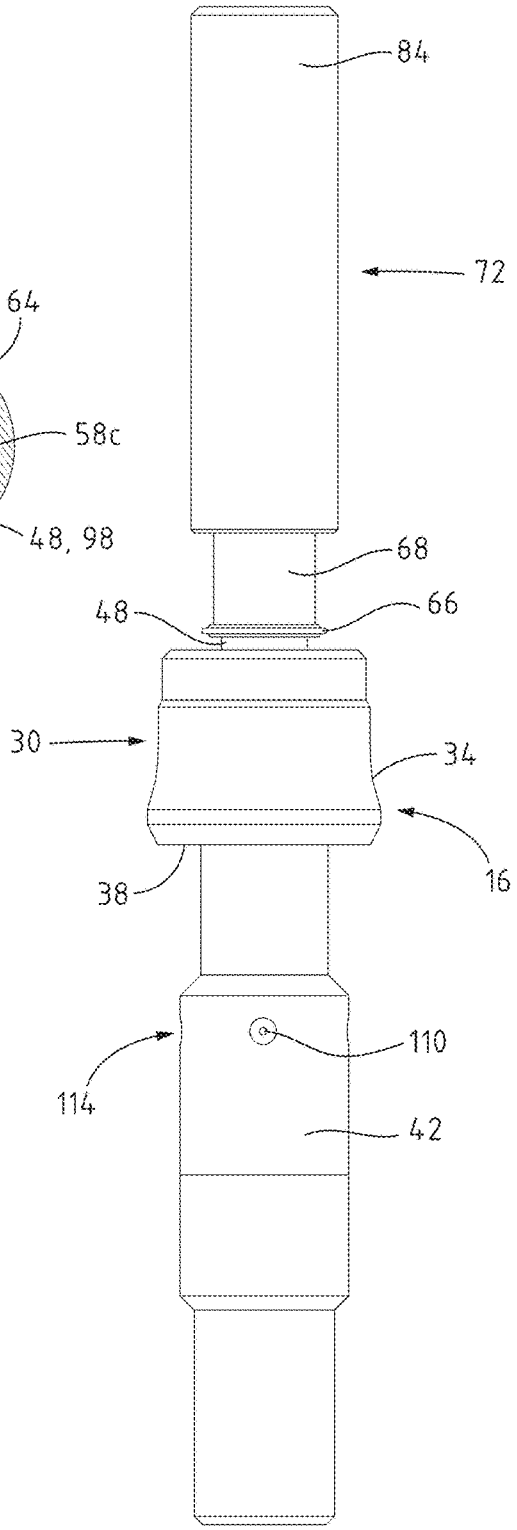
Figure 12:
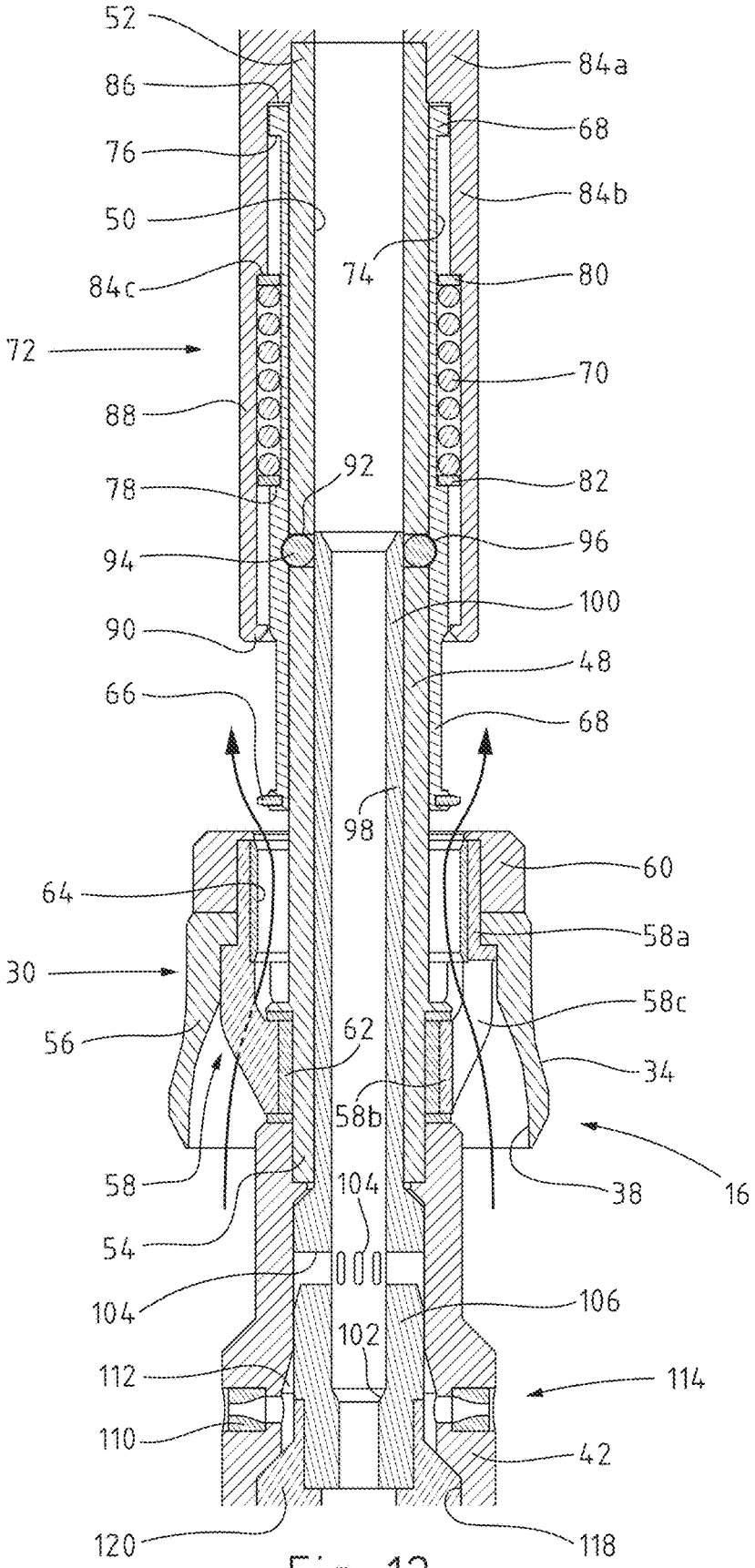

FIGS. 9-12 show the fluid diverter tool 16 and the second jetting tool 42 as configured in a run-in position for introduction in said pipe body 4 in the well 2. FIG. 12 shows an enlarged version of this tool configuration, whereas FIG. 11 shows a transverse cross section through the diverter tool 16 taken along section line A-A in FIG. 9.

Further, FIGS. 9-17 show specific features, including internal features, of the fluid diverter tool 16 and the second jetting tool 42 (and said check valve arrangement) connected thereto for carrying out the plugging operation described above. These figures also show various positions of components of the diverter tool 16 and the second jetting tool 42, as applicable to the various functions thereof. Enlarged versions of the various tool configurations are also depicted in FIGS. 13-17.

The diverter tool 16 comprises a tubular mandrel 48 with a longitudinal bore 50 therethrough and having a first (upper) end 52 connected to said tubular work string 20, and a second (lower) end 54 operably connected to the second jetting tool 42. The swab cup 30 is rotatably affixed to an exterior surface of the mandrel 48 and is located between the first and second ends 52, 54 thereof. Further, the swab cup 30 comprises a cup-shaped packer body 56 formed from a resilient material. An upper side of the packer body 56 defines said first (convex) side 34 of the swab cup 30 and faces the first end 52 of the mandrel 48, whereas a lower side of the packer body 56 defines said second (concave) side 38 of the swab cup 30 and faces the second end 54 of the mandrel 48. The swab cup 30 also includes a tubular support body 58 formed (e.g. machined) or assembled (from individual parts) so as to comprise an outer support ring **58*a*, an inner support ring 58*b* and a plurality of support struts 58*c* extending axially and transversely between the inner and outer support rings 58*a*, 58*b*. The support struts 58*c* are spaced apart circumferentially so as to allow bypass of fluids when required. The packer body 56 is mounted onto the outer support ring 58*a* and is held in place by an adjoining retainer ring 60. The inner support ring 58*b* is rotatably mounted onto a low friction bushing 62 (or a suitable bearing) affixed to the exterior surface of the mandrel 48 at (i.e. below) the second side 38 of the swab cup 30. The bushing 62 is made from a suitable low friction material, for example brass or a composite plastics material. This rotary arrangement supports the swab cup 30 on the mandrel 48 and allows relative rotation of the mandrel 48 and the second jetting tool 42 with respect to the swab cup 30 when rotating said work string 20 during operation in the well 2, as indicated with a curved arrow in FIGS. 5 and 6**.

Figure 14:
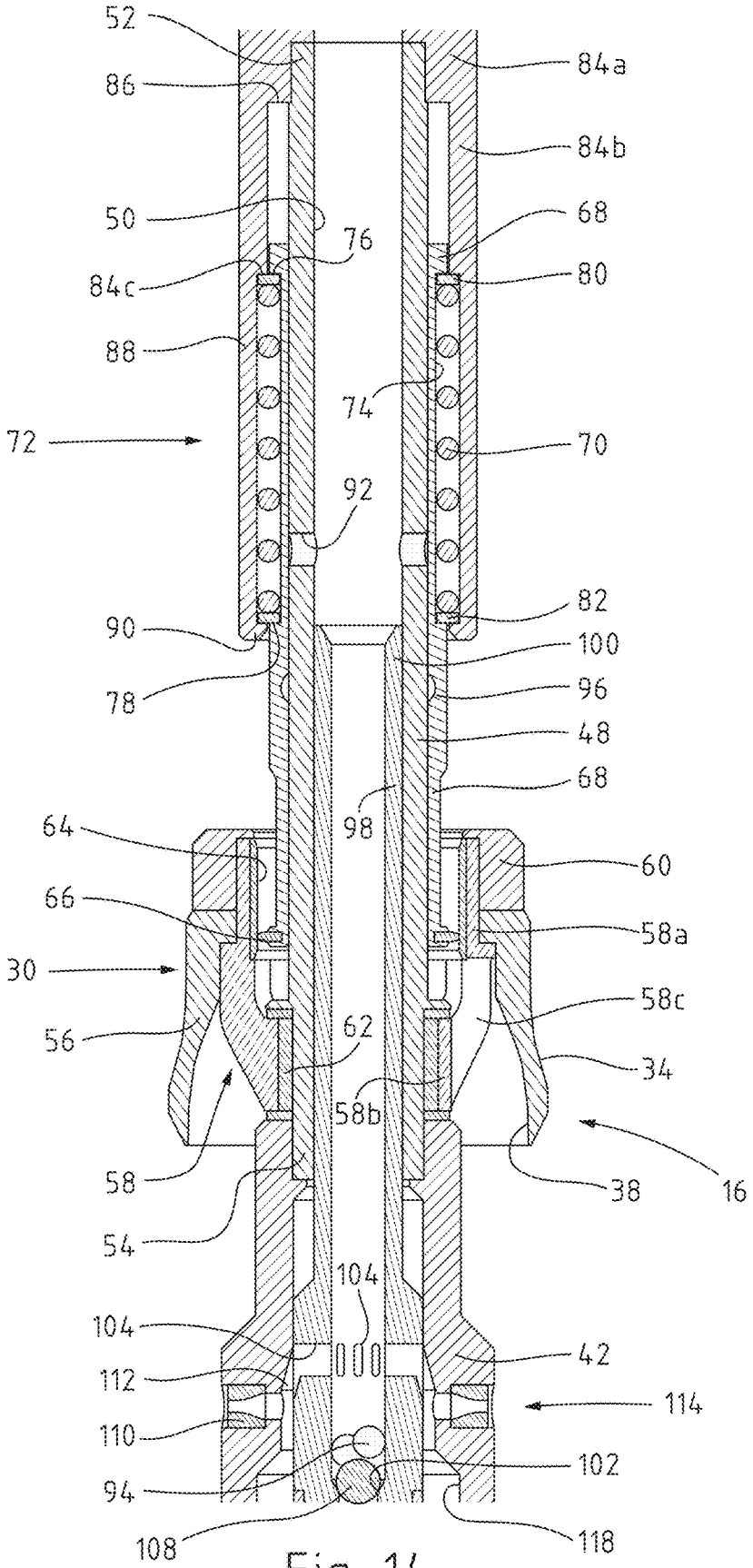
Figure 15:
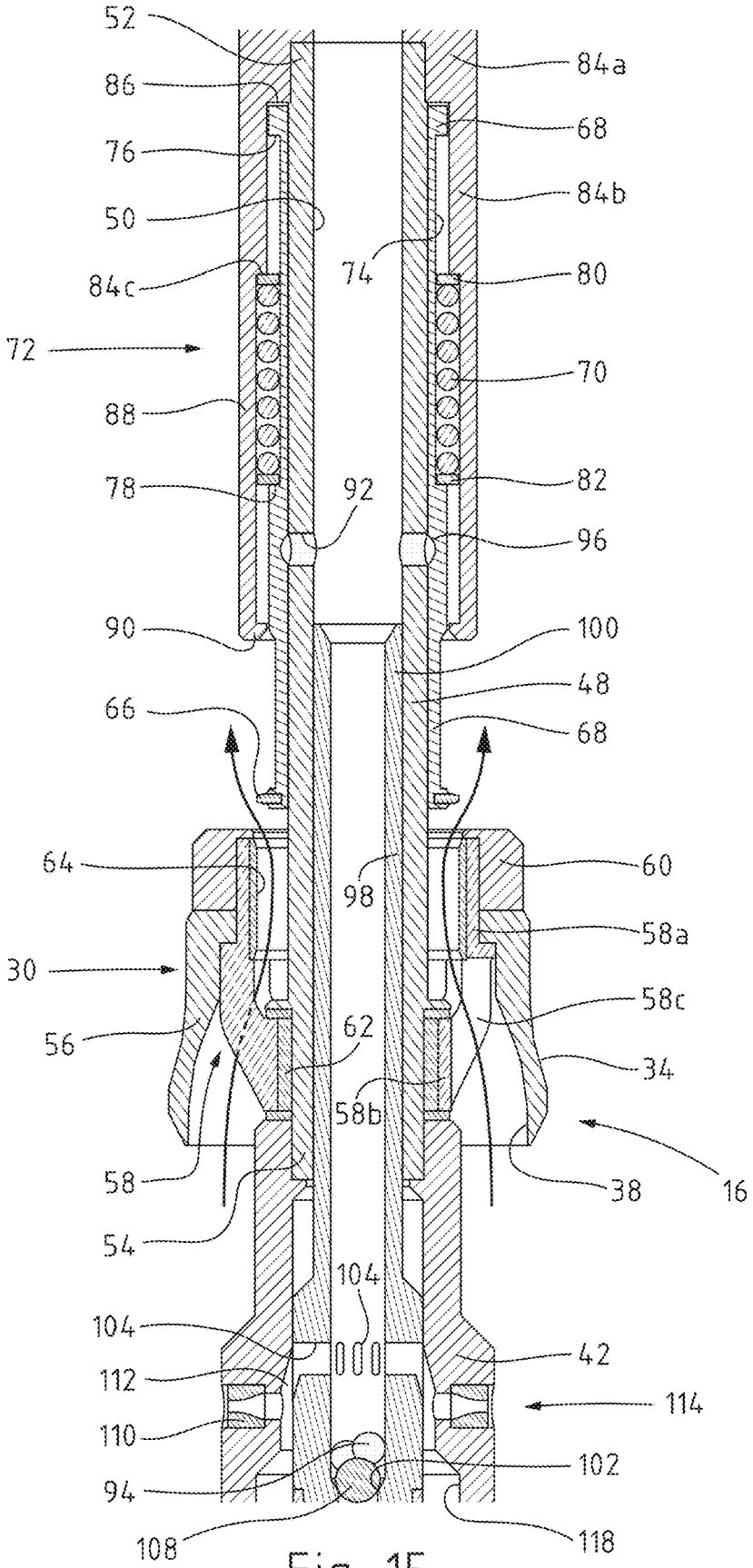
Figure 16:
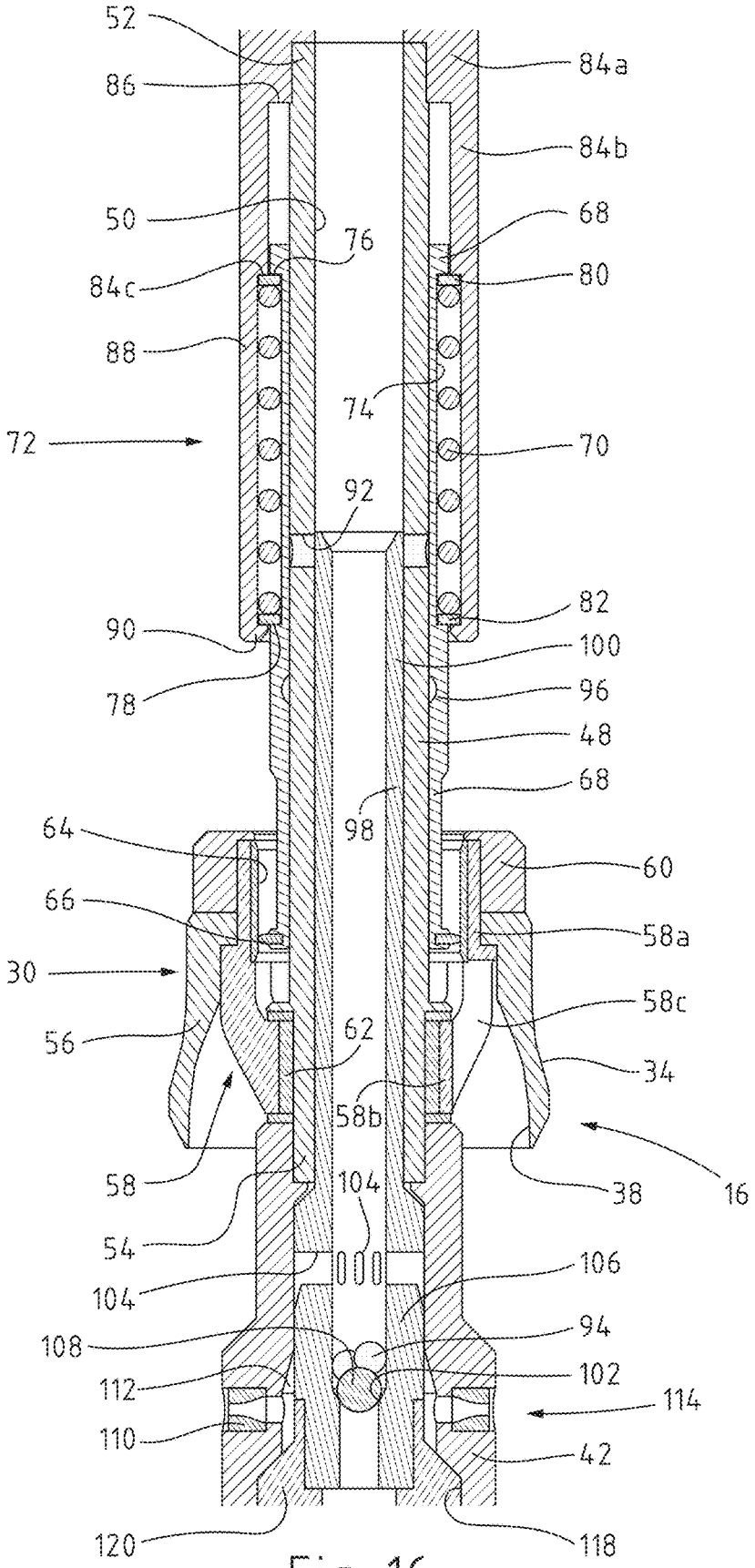

In this embodiment, said pressure relief device 40 of the diverter tool 16 comprises an annular relief channel 64 formed between the mandrel 48 and an inside of the outer support ring **58*a* of the swab cup 30. The relief channel 64 extends longitudinally between the first and second sides 34**, 38 of the swab cup 30 so as to separate the mandrel 48 from the outer support ring 58*a* and packer body 56 of the swab cup 30. The pressure relief device 40 also comprises an annular seal body 66 shaped and operable to sealingly engage the annular relief channel 64 when located at any position within and along the relief channel 64 so as to define a closed seal position of the annular seal body 66. In this embodiment, the annular seal body 66 seals against said inside of the outer support ring 58*a* and thus defines an outer extremity of the annular relief channel 64. The annular seal body 66 is made from a resilient material, for example rubber or elastomer material, and is capable of flexing and sealing against said inside of the outer support ring 58*a*. The annular seal body 66 is affixed to an exterior surface of an end of a seal sleeve 68, which is slidably and sealingly disposed around the mandrel 48 at (i.e. above) the first side 34 of the swab cup 30. The slidable seal sleeve 68 allows longitudinal (axial) movement of the annular seal body 66 between a closed seal position within the annular relief channel 64 and a first open seal position at (i.e. above) the first side 34 of the swab cup 30. This allows the annular relief channel 64 to be closed and opened, as shown in FIGS. 14 and 16 and in FIGS. 9-13, 15 and 17, respectively. The diverter tool 16 also comprises a biasing device 70 in the form of a coil spring disposed around the mandrel 48 above the first side 34 of the swab cup 30. The coil spring 70 is in operable contact with the slidable seal sleeve 68. When activated and operational in the well 2, the coil spring 70 biases the slidable seal sleeve 68 and thus the annular seal body 66 towards its closed seal position within the annular relief channel 66, as shown in FIGS. 14 and 16.

Figure 9:
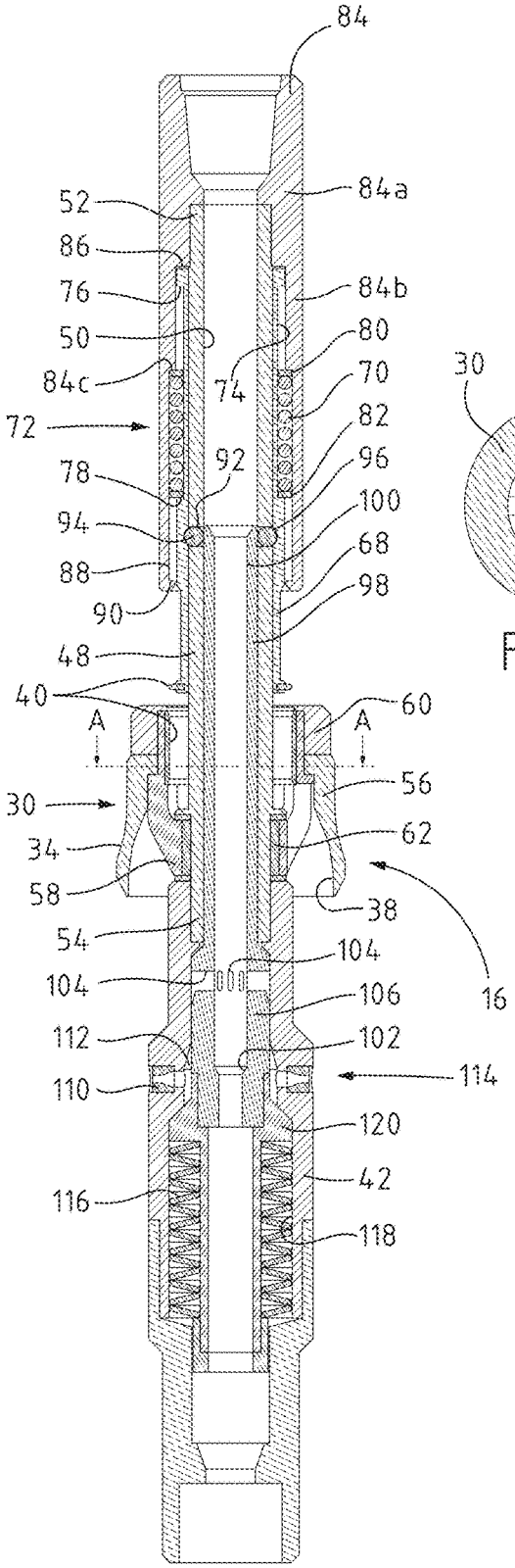
FIGS. 9-17 show a side view, mostly in cross section, of various features and configurations of the fluid diverter tool as used in successive steps of forming a cross-sectional cement plug in the well.
Figure 13:
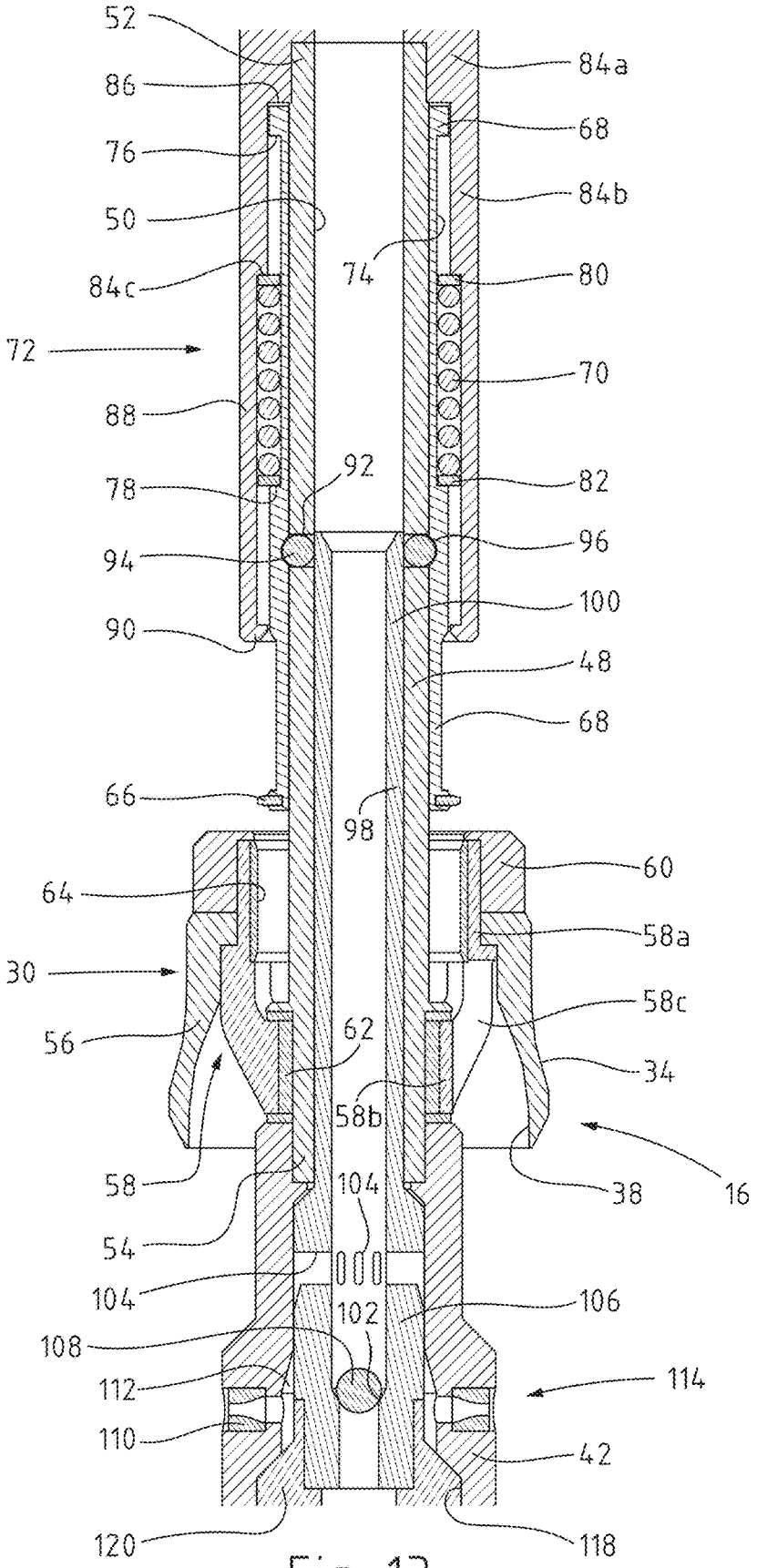

Said coil spring 70 is also an integral part of a releasable holding mechanism 72 operable to releasably hold the annular seal body 66, and thus the slidable seal sleeve 68 to which it is affixed, in an open holding position at (i.e. above) the first side 34 of the swab cup 30 before operating the diverter tool 16 in the well 2, as shown in FIGS. 9-13. This allows fluids to pass through the annular relief channel 64, as shown with downstream-directed arrows in FIG. 12, and thus facilitates insertion of the diverter tool 16 and said jetting tool 42 in the well 2. The holding mechanism 72 also comprises a recessed section 74 formed in the exterior surface of the slidable seal sleeve 68 and defined between a first ledge 76 and an opposite second ledge 78 thereof. A first detent ring 80 and a second detent ring 82 are slidably disposed on the recessed section 74 so at to be moveable between said first and second ledges 76, 78 thereof. The coil spring 70 is disposed between the detent rings 80, 82 and may thus be expanded or compressed within the confines of the first and second ledges 78, 80. The holding mechanism 72 also includes a housing 84 comprising a housing proper 84*a* and an adjoining housing sleeve 84*b* extending towards the swab cup 30 and around the mandrel 48. A first internal ledge 86 defined between the housing proper 84*a* and the housing sleeve 84*b* serves to limit the longitudinal movement of the slidable seal sleeve 68, and thus of the annular seal body 66, towards its first open seal position, as shown in FIG. 15. A second internal ledge 84*c* of the housing sleeve 84*b* serves to limit longitudinal movement of the first detent ring 80, and thus of the coil spring 70, away from the swab cup 30, as shown in FIGS. 9, 12 and 13. A finger sleeve 88 is also affixed to an exterior surface of the housing sleeve 84*b* and extends further towards the swab cup 30 so as to enclose the first and second detent rings 80, 82 and their intermediate coil spring 70. A free end of the finger sleeve 88 is provided with a plurality of inwardly protruding fingers 90 serving to limit longitudinal movement of said second detent ring 82, and thus of the coil spring 70, towards the swab cup 30, as shown in FIGS. 9, 12 and 13. When releasably held in said open holding position, the sliding seal sleeve 68 abuts the internal ledge 86 of the housing 84 whilst the first detent ring 80 simultaneously abuts the first ledge 76 of the recessed section 74 and holds the coil spring 70 in a compressed state between the first and second detent rings 80, 82, as shown in FIGS. 9, 12 and 13. Said housing proper 84*a* is also connected to the first end 52 of the mandrel 48 and is adapted for connection to the lower end of said tubular work string 20.

Further, the releasable holding mechanism 72 includes a plurality of radial holes 92 formed in the mandrel 48 and spaced apart along its circumference. Each hole 92 is provided with a retaining ball 94 having an outer part extending into a circumferential retaining groove 96 formed in an interior surface of the sliding seal sleeve 68. The retaining groove 96 defines an outer radial position for the retaining balls 94. In this outer position, the retaining balls 94 serve to releasably hold the sliding seal sleeve 68 and its annular seal body 66 in said open holding position. An activation sleeve 98 is positioned within the longitudinal bore 50 of the mandrel 48 and is slidably disposed therein between a first activation position and a second activation position. When in the first activation position, a proximate end 100 of the activation sleeve 98 covers said holes 92 in the mandrel 48 so as to hold the retaining balls 94 in said outer radial position, as shown in FIGS. 9 and 12. When in second activation position, the proximate end 100 of the activation sleeve 98 does not cover said holes 92 and thus allows the retaining balls 94 to move to an inner radial position within the mandrel 48 so as to release the holding mechanism 72.

In order to facilitate movement from the first to the second activation position, the activation sleeve 98 includes an internal ball seat 102 and a plurality of radial discharge ports 104 formed at an opposite distal end 106 thereof. The radial discharge ports 104 are distributed along the circumference of said distal end 106. The ball seat 102 is adapted to receive an activation ball 108 dropped down from the surface of the well 2 via said tubular work string 20, as shown in FIG. 13. Upon subsequently pumping cement slurry 46 down the tubular work string 20 and thus pressurizing the activation ball 108 and its ball seat 102, the activation sleeve 98 is moved downwards to said second activation position, as shown in FIG. 14. This movement of the activation sleeve 98 to its second activation position uncovers said radial holes 92 in the mandrel 48 and allows the retaining balls 94 to drop into the mandrel 48 and down onto the activation ball 108, which simultaneously releases the slidable seal sleeve 68 disposed on the mandrel 48. The release of the slidable seal sleeve 68 allows the compressed coil spring 70 to rapidly expand and move the slidable seal sleeve 68 and its annular seal body 66 from said open holding position to said closed and biased seal position within the annular relief channel 64, thereby also defining an operational position of the fluid diverter tool 16.

Movement of the activation sleeve 98 to its second activation position also operates to activate the second jetting tool 42, which is connected to the second (lower) end 54 of the mandrel 48. The second jetting tool 42 is provided with a plurality of outwardly directed nozzles 110 dispersed along a circumference thereof and embedded as nozzle inserts in a wall of the jetting tool 42. The nozzles 110 are connected to corresponding discharge conduits 112 formed through the wall of the jetting tool 42. In this embodiment, the second jetting tool 42 also includes a check valve 114 comprising a coil spring 116 disposed within a housing bore 118 of the jetting tool 42 and around a carrier sleeve 120 slidable arranged within the jetting tool 42, as shown in FIG. 9. The carrier sleeve 120 is connected to the distal end 106 of said activation sleeve 98 (within the mandrel 4) so as to allow the coil spring 116 to bias the activation sleeve 98 in its first activation position and thus cover said radial holes 92 in the mandrel 48, as shown in FIGS. 9-13. In this first activation position, said radial discharge ports 104 in the activation sleeve 98 do not register with the discharge conduits 112 in the jetting tool 42, thereby closing the check valve 114 and preventing jetting of the cement slurry 46 from the nozzles 110 in the jetting tool 42. Upon increasing the cement slurry pressure (above the seated activation ball 108) to a predetermined level, the activation sleeve 98 is moved downward to its second activation position, as shown in FIG. 14, so as to open the check valve 114 and compress the coil spring 116 within said housing bore 118 of the jetting tool 42. In this second activation position, the discharge ports 104 in the activation sleeve 98 do register with the discharge conduits 112 in the jetting tool 42 so as to allow cement slurry 46 to be jetted from the nozzles 110 of the jetting tool 42, thereby also defining an operational position of the second jetting tool 42.

FIG. 14 shows the fluid diverter tool 16 and the second jetting tool 42 in their respective operational positions for carrying out the plugging operation shown in FIGS. 5-6, and after having released the holding mechanism 72 of the diverter tool 16, as described above. In this operational position, the annular seal body 66 is located in its closed seal position within the annular relief channel 64. The coil spring 70 (in the holding mechanism 72) has also been released and expanded so as to bias the slidable seal sleeve 68 and its annular seal body 66 towards said closed seal position within the annular relief channel 66. When in this expanded position, the protruding fingers 90 of said finger sleeve 88 serve to limit longitudinal movement of the coil spring 70, and thus of the slidable seal sleeve 68, towards the swab cup 30, which also limits the extent of longitudinal movement of the annular seal body 66 within the annular relief channel 64. Simultaneously, the check valve 114 is open so as to allow operation of the second jetting tool 42.

FIG. 15 shows the swab cup 30 and its pressure relief device 40 as configured in a pressure relief position when exposed, during operation, to said first pressure differential across the pressure relief device 40. The check valve 114 is still open to allow operation of the jetting tool 42. In this embodiment, this relief configuration pertains to the situation shown in FIG. 6, in which the diverter tool 16 is positioned at said flow-inhibiting blockage zone 14 so as to inhibit diversion of cement slurry 46 into said annulus 6. As described above, this flow blockage increases the pressure in the second pipe region 36 sufficiently to generate said first pressure differential across the pressure relief device 40, which in turn is operable to open the pressure relief device 40 and relieve pressure (and fluid flow) from the second pipe region 36 to the first pipe region 32 of the pipe body 4. This pressure differential also serves to force the annular seal body 66 and its slidable seal sleeve 68 away from the swab cup 30 and into a first open seal position at (i.e. above) said first side 34 of the swab cup 30, as shown in FIG. 15. In this embodiment, this first open seal position coincides with said open holding position associated with the releasable holding mechanism 72. The direction of pressure relief is shown with downstream-directed arrows in FIG. 15.

FIG. 16 shows the swab cup 30 and its pressure relief device 40 as configured in a neutral (inoperative) position after having stopped pumping of cement slurry 46, or after having completed the plugging operation, and thus having lowered the pressure in the cement slurry 46 to below said predetermined level. In such an event, the inherent energy of the compressed coil spring 116 of the check valve 114 overcomes the fluid pressure and forces the activation sleeve 98 back upwards to its first activation position so as to close the check valve 114. By so doing, the check valve 114 prevents so-called U-tubing when a high-density cement slurry 46 is pumped into the well 2, which serves to avoid or reduce any mixing of the cement slurry 46 with ambient fluids in the well 2 so as to contaminate the cement slurry 46. Such a stop in the pumping of cement slurry 46 may occur when "making a connection" to add or remove a tubular element (i.e. a "pipe joint") in the tubular work string 20 (e.g. jointed drill string) in context of inserting or withdrawing the work string 20 from the well 2. In this neutral position, however, the annular seal body 66 is still in its closed seal position within the annular relief channel 64 of the swab cup 30.

Figure 17:
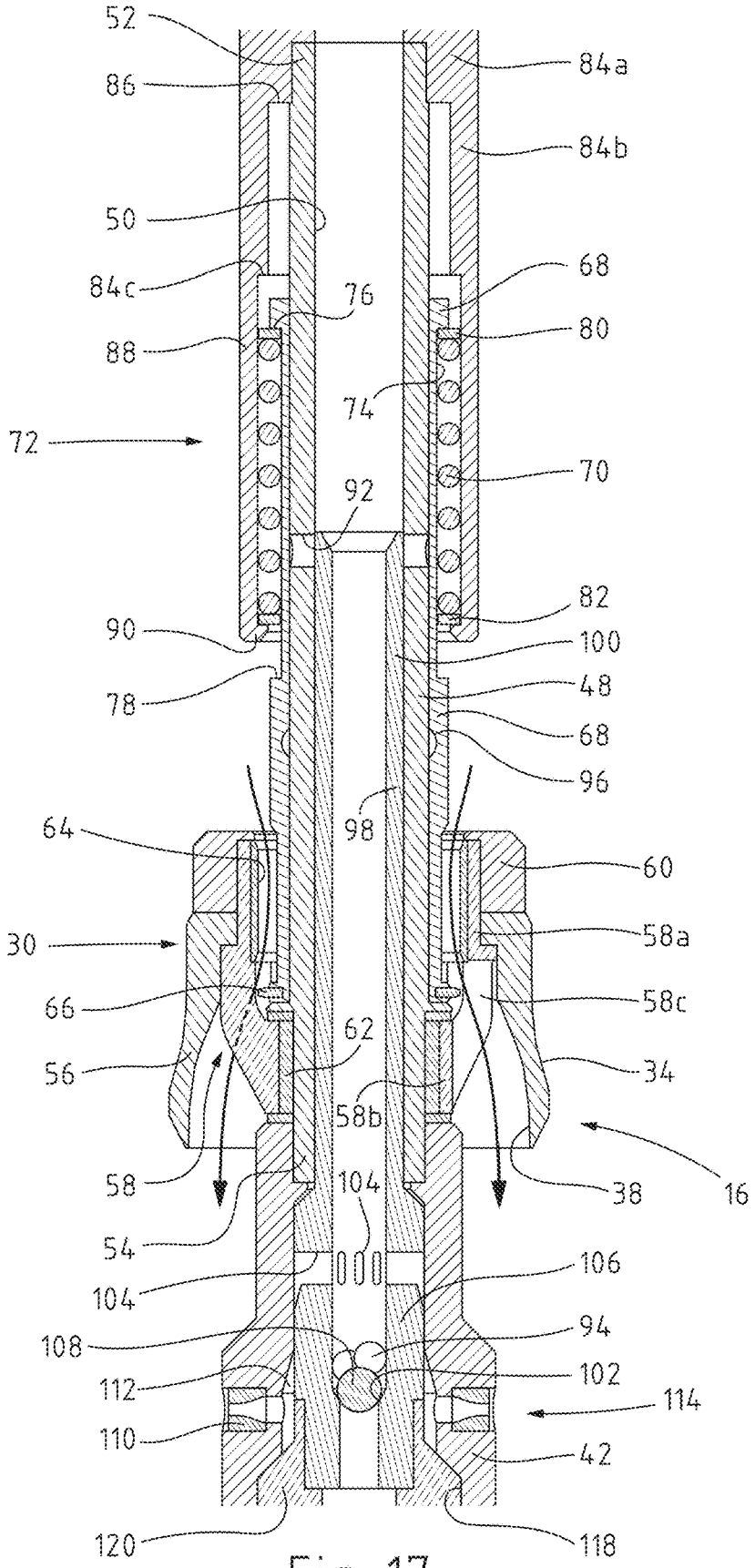

FIG. 17 shows the swab cup 30 and its pressure relief device 40 as configured in a withdrawal position after having completed the plugging operation (or as configured with a column of cement slurry 46 on top of the swab cup 30 during the plugging operation described above in context of FIG. 5). When withdrawing the diverter tool 16 and second jetting tool 42 from the well 2, the ambient fluid 18 in the pipe body 4 generates a second pressure differential acting on the annular seal body 66 from the first (upper) side 34 of the swab cup 30. The second pressure differential is operable to move the annular seal body 66 longitudinally from its closed seal position within the annular relief channel 64 to a second open position at (i.e. below) the opposite second side 38 of the swab cup 30, which allows the annular relief channel 64 to be opened in the opposite direction. Movement of the annular seal body 66 to this second open position is possible because the bias afforded by said coil spring 70 (of the diverter tool 16), which is connected to the slidable seal sleeve 68 at (i.e. above) the first side of the swab cup 30, also is adapted to yield in the opposite direction upon exposure to said second pressure differential. During this opposite movement, the slidable seal sleeve 68 is moved away from its abutment with the internal ledge 86 of said housing 84 whilst simultaneously compressing the coils spring 70 within the confines of the first and second ledges 78, 80. As shown in FIG. 17, the longitudinal movement of the slidable seal sleeve 68, and thus of the annular seal body 66, towards said second open position is limited by the protruding fingers 90 of the finger sleeve 88 on said housing sleeve **84*b*. Preferably, said second pressure differential acting from the first side 34 of the swab cup 30 is lower than said first pressure differential acting from the second side 38 of the swab cup 30, which facilitates easy upward movement or withdrawal of the diverter tool 16 from the pipe body 4**.

It is to be understood that the functions and modes of configuration and operation, as disclosed in the above embodiment and figures of the present fluid diverter tool, system and method, also may be used with any other embodiments disclosed herein, and in any combination thereof, as defined within the scope of the subsequent claims.

The invention claimed is:

1. A fluid diverter tool for use in a pipe body in a well, the diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards;

wherein in that the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element, such that flow of the treatment fluid from the second side to the first side of the packer element and discharge of the treatment fluid from said second end of the mandrel are allowed simultaneously; and wherein the pressure relief device is adapted to close upon exposure to a lower than said first pressure differential acting across the pressure relief device from the second side of the packer element;

wherein the pressure relief device also comprises:

at least one relief channel extending through the packer element between the first and second sides thereof; and at least one seal body shaped and operable to sealingly engage and close said relief channel when in a closed seal position, said seal body also operable to move between the closed seal position and a first open seal position at the first side of the packer element so as to allow said relief channel to be closed and opened;

wherein the seal body is biased towards the closed seal position; and wherein said bias of the seal body is adapted to yield upon exposure to said first pressure differential so as to allow the seal body to move towards the first open seal position at the first side of the packer element and relieve pressure from the second side to the first side of the packer element, characterized in that said relief channel comprises an annular relief channel located between the mandrel and the packer element and extending longitudinally within the packer element so as to separate the mandrel from the packer element;

wherein support elements extend between the packer element and the mandrel for supporting the packer element on the mandrel;

wherein said seal body comprises an annular seal body slidably disposed on the mandrel for allowing longitudinal movement of the annular seal body between the closed seal position and the first open seal position at the first side of the packer element; and wherein the annular seal body is shaped and operable to sealingly engage the annular relief channel when located therein so as to define the closed seal position of the annular seal body.

2. The fluid diverter tool according to claim 1, wherein the annular seal body is affixed to a seal sleeve slidably disposed on the mandrel for allowing said longitudinal movement of the annular seal body between the closed seal position and the first open seal position at the first side of the packer element; and wherein the seal sleeve is biased towards the closed seal position, thereby also biasing the annular seal body towards the closed seal position.

3. The fluid diverter tool according to claim 1, comprising a releasable holding mechanism operable to releasably hold said seal body in an open holding position at the first side of the packer element before operating the diverter tool in said pipe body.

4. The fluid diverter tool according to claim 1, wherein the packer element comprises one of:

a radially extending collar adapted and operable to sealingly engage the inside of said pipe body; and an expandable packer adapted and operable to expand radially to sealingly engage the inside of said pipe body.

5. The fluid diverter tool according to claim 1, wherein the packer element is rotatably connected to the mandrel to allow rotation of the mandrel relative to the packer element.

6. A system for diverting a fluid flow in a well, the system comprising:

at least one pipe body disposed in the well, the at least one pipe body comprising an innermost pipe body;

at least one annulus, including an innermost annulus, located between the innermost pipe body and a surrounding borehole wall of the well; and a plurality of holes formed through a wall of said at least one pipe body and dispersed along a longitudinal section of the well to allow communication between the at least one pipe body and the at least one annulus, characterized in that the system also comprises a fluid diverter tool positioned in the innermost pipe body at said longitudinal section of the well, the fluid diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards, wherein the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element, such that flow of the treatment fluid from the second side to the first side of the packer element and discharge of the treatment fluid from said second end of the mandrel are allowed simultaneously; and wherein the pressure relief device is adapted to close upon exposure to a lower than said first pressure differential acting across the pressure relief device from the second side of the packer element;

wherein said second end of the mandrel of the diverter tool is operably connected to a treatment tool adapted and operable to discharge said treatment fluid into the innermost pipe body;

wherein said packer element of the diverter tool is in sealing engagement with an inside of the innermost pipe body to allow, if possible, a flow of the treatment fluid to be diverted outwards into the at least one annulus via one or more of said holes in the at least one pipe body along the longitudinal section, the packer element defining a first pipe region above said first side of the packer element and a second pipe region below said second side of the packer element; and wherein said pressure relief device of the diverter tool is operable to open and relieve pressure from the second pipe region to the first pipe region upon exposure to a fluid pressure in the second pipe region being sufficient to generate said first pressure differential across the pressure relief device.

7. The system according to claim 6, comprising a tubular work string disposed in the innermost pipe body and having a lower end connected to said first end of the mandrel of the diverter tool for operating the diverter tool and the treatment tool in the innermost pipe body, and for supplying the treatment fluid thereto.

8. The system according to claim 6, wherein the treatment tool comprises at least one of:

a jetting tool adapted and operable to discharge jets of treatment fluid directed outwards into the at least one annulus via said one or more holes in the at least one pipe body; and an open-ended pipe section adapted and operable to discharge the treatment fluid directly into the innermost pipe body.

9. The system according to claim 8, wherein the jetting tool includes a check valve adapted and operable to open upon exposure to a predetermined fluid pressure and discharge said jets of treatment fluid.

10. The system according to claim 6, wherein the pressure relief device comprises at least one pressure relief valve disposed within at least one corresponding relief channel extending through the packer element between the first and second sides thereof.

11. The system according to claim 6, wherein the pressure relief device comprises:

at least one relief channel extending through the packer element between the first and second sides thereof; and at least one seal body shaped and operable to sealingly engage and close said relief channel when in a closed seal position, said seal body also operable to move between the closed seal position and a first open seal position at the first side of the packer element so as to allow said relief channel to be closed and opened;

wherein the seal body is biased towards the closed seal position; and wherein said bias of the seal body is adapted to yield upon exposure to said first pressure differential so as to allow the seal body to move towards the first open seal position at the first side of the packer element and relieve pressure from the second side to the first side of the packer element.

12. The system according to claim 11, wherein said relief channel comprises an annular relief channel located between the mandrel and the packer element and extending longitudinally within the packer element so as to separate the mandrel from the packer element;

wherein support elements extend between the packer element and the mandrel for supporting the packer element on the mandrel;

wherein said seal body comprises an annular seal body slidably disposed on the mandrel for allowing longitudinal movement of the annular seal body between the closed seal position and the first open seal position at the first side of the packer element; and wherein the annular seal body is shaped and operable to sealingly engage the annular relief channel when located therein so as to define the closed seal position of the annular seal body.

13. The system according to claim 12, wherein the annular seal body is affixed to a seal sleeve slidably disposed on the mandrel for allowing said longitudinal movement of the annular seal body between the closed seal position and the first open seal position at the first side of the packer element; and wherein the seal sleeve is biased towards the closed seal position, thereby also biasing the annular seal body towards the closed seal position.

14. The system according to claim 11, wherein the fluid diverter tool comprises a releasable holding mechanism operable to releasably hold said seal body in an open holding position at the first side of the packer element before operating the diverter tool in said pipe body.

15. The system according to claim 6, wherein the packer element comprises one of:

a radially extending collar adapted and operable to sealingly engage the inside of said pipe body; and an expandable packer adapted and operable to expand radially to sealingly engage the inside of said pipe body.

16. The system according to claim 15, wherein the radially extending collar is a cup-shaped packer; and wherein the expandable packer is an axially compressible packer adapted and operable to expand radially upon axial compression thereof.

17. The system according to claim 6, wherein the packer element is rotatably connected to the mandrel to allow rotation of the mandrel relative to the packer element.

18. A method of diverting a fluid flow in a well, the well comprising:

at least one pipe body, the at least one pipe body comprising an innermost pipe body;

at least one annulus, including an innermost annulus, located between the innermost pipe body and a surrounding borehole wall of the well;

a plurality of holes formed through a wall of said at least one pipe body and dispersed along a longitudinal section of the well to allow communication between the at least one pipe body and the at least one annulus, characterized in that the method comprises the steps of:

a) using a fluid diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards;

wherein the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element, such that flow of the treatment fluid from the second side to the first side of the packer element and discharge of the treatment fluid from said second end of the mandrel are allowed simultaneously; and wherein the pressure relief device is adapted to close upon exposure to a lower than said first pressure differential acting across the pressure relief device from the second side of the packer element; and operably connecting said second end of the mandrel of the diverter tool to a treatment tool adapted and operable to allow discharge of said treatment fluid;

b) positioning the diverter tool and the treatment tool in the innermost pipe body at said longitudinal section of the well;

c) sealingly engage said packer element of the diverter tool with an inside of the innermost pipe body so as to define a first pipe region above said first side of the packer element and a second pipe region below said second side of the packer element;

d) displacing the treatment fluid through the diverter tool and the treatment tool so as to discharge into the second pipe region of the innermost pipe body and, if possible, allowing said packer element of the diverter tool to divert a flow of the treatment fluid outwards into the at least one annulus via one or more of said holes in the at least one pipe body along the longitudinal section; and e) allowing said pressure relief device of the diverter tool to open and relieve pressure from the second pipe region to the first pipe region of the innermost pipe body upon exposure to a fluid pressure in the second pipe region being sufficient to generate said first pressure differential across the pressure relief device.

19. The method according to claim 18, comprising connecting said first end of the mandrel to a lower end of a tubular work string for operating the diverter tool and the treatment tool in the innermost pipe body, and for supplying the treatment fluid thereto.

20. The method according to claim 18, further comprising moving the diverter tool and the treatment tool along the longitudinal section whilst displacing the treatment fluid in step d.

21. The method according to claim 18, further comprising rotating the treatment tool whilst displacing the treatment fluid in step d.

22. The method according to claim 18, wherein the displacing of treatment fluid in step d operates to increase the fluid pressure in the second pipe region sufficiently to generate the first pressure differential and thus open the pressure relief device in step e.

23. The method according to claim 18, wherein step d comprises displacing the treatment fluid into the second pipe region at a location wherein at least the innermost annulus includes a flow-inhibiting blockage zone within the longitudinal section of the well, said blockage zone inhibiting diversion of the flow of treatment fluid outwards into said annulus via one or more of said holes in the at least one pipe body; and wherein the displacing of treatment fluid at the blockage zone operates to increase the fluid pressure in the second pipe region sufficiently to generate the first pressure differential and thus open the pressure relief device in step e.

24. The method according to claim 18, comprising setting the first pressure differential lower than a fluid pressure required in the second pipe region to break down at least one of the packer element and the surrounding borehole wall of the well.

25. The method according to claim 18, wherein the treatment tool comprises a jetting tool adapted and operable to discharge jets of treatment fluid from the jetting tool; and wherein step d comprises directing said jets of treatment fluid outwards into the at least one annulus via one or more of said holes in the at least one pipe body.

26. The method according to claim 18, wherein the treatment fluid is a fluid selected from a group comprising:

a washing fluid for cleaning in the at least one annulus;

a spacer fluid for conditioning surfaces defining the at least one annulus; and a fluidized plugging material for forming a plug in the at least one annulus and the at least one pipe body along at least the longitudinal section of the well.

27. The method according to claim 18, comprising using the method in an operation for forming a plug in the at least one annulus and the at least one pipe body along at least the longitudinal section of the well;

wherein the treatment fluid is a fluidized plugging material;

wherein the treatment tool comprises a jetting tool adapted and operable to discharge jets of fluidized plugging material from the jetting tool; and wherein step d comprises directing said jets of fluidized plugging material outwards into the at least one annulus via one or more of said holes in the at least one pipe body so as to facilitate said plugging of the well.

28. A fluid diverter tool for use in a pipe body in a well, the diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards;

wherein the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element, such that flow of the treatment fluid from the second side to the first side of the packer element and discharge of the treatment fluid from said second end of the mandrel are allowed simultaneously; and wherein the pressure relief device is adapted to close upon exposure to a lower than said first pressure differential acting across the pressure relief device from the second side of the packer element;

wherein the pressure relief device also comprises:

at least one relief channel extending through the packer element between the first and second sides thereof; and at least one seal body shaped and operable to sealingly engage and close said relief channel when in a closed seal position, said seal body also operable to move between the closed seal position and a first open seal position at the first side of the packer element so as to allow said relief channel to be closed and opened;

wherein the seal body is biased towards the closed seal position; and wherein said bias of the seal body is adapted to yield upon exposure to said first pressure differential so as to allow the seal body to move towards the first open seal position at the first side of the packer element and relieve pressure from the second side to the first side of the packer element, characterized in that the fluid diverter tool also comprises a releasable holding mechanism operable to releasably hold said seal body in an open holding position at the first side of the packer element before operating the diverter tool in said pipe body.

29. The fluid diverter tool according to claim 28, wherein the packer element comprises one of:

a radially extending collar adapted and operable to sealingly engage the inside of said pipe body; and an expandable packer adapted and operable to expand radially to sealingly engage the inside of said pipe body.

30. The fluid diverter tool according to claim 28, wherein the packer element is rotatably connected to the mandrel to allow rotation of the mandrel relative to the packer element.

31. A fluid diverter tool for use in a pipe body in a well, the diverter tool comprising:

a tubular mandrel with a longitudinal bore therethrough and having a first end and an opposite second end, said first end operable to allow receipt of a treatment fluid, and said second end operable to allow discharge of the treatment fluid;

a packer element affixed to an exterior surface of the tubular mandrel and located between the first and second ends of the mandrel, the packer element having a first side facing the first end of the mandrel and an opposite second side facing the second end of the mandrel, said packer element shaped and operable to sealingly engage an inside of said pipe body to allow a flow of the treatment fluid to be diverted outwards;

wherein the packer element comprises a pressure relief device adapted and operable, when open, to relieve pressure from the second side to the first side of the packer element;

wherein the pressure relief device is adapted to open upon exposure to a first pressure differential acting across the pressure relief device from the second side of the packer element, such that flow of the treatment fluid from the second side to the first side of the packer element and discharge of the treatment fluid from said second end of the mandrel are allowed simultaneously; and wherein the pressure relief device is adapted to close upon exposure to a lower than said first pressure differential acting across the pressure relief device from the second side of the packer element, characterized in that the packer element is rotatably connected to the mandrel to allow rotation of the mandrel relative to the packer element.

32. The fluid diverter tool according to claim 31, wherein the pressure relief device comprises at least one pressure relief valve disposed within at least one corresponding relief channel extending through the packer element between the first and second sides thereof.

33. The fluid diverter tool according to claim 31, wherein the pressure relief device comprises:

at least one relief channel extending through the packer element between the first and second sides thereof; and at least one seal body shaped and operable to sealingly engage and close said relief channel when in a closed seal position, said seal body also operable to move between the closed seal position and a first open seal position at the first side of the packer element so as to allow said relief channel to be closed and opened;

wherein the seal body is biased towards the closed seal position; and wherein said bias of the seal body is adapted to yield upon exposure to said first pressure differential so as to allow the seal body to move towards the first open seal position at the first side of the packer element and relieve pressure from the second side to the first side of the packer element.

34. The fluid diverter tool according to claim 33, wherein said relief channel comprises an annular relief channel located between the mandrel and the packer element and extending longitudinally within the packer element so as to separate the mandrel from the packer element;

wherein support elements extend between the packer element and the mandrel for supporting the packer element on the mandrel;

wherein said seal body comprises an annular seal body slidably disposed on the mandrel for allowing longitudinal movement of the annular seal body between the closed seal position and the first open seal position at the first side of the packer element; and wherein the annular seal body is shaped and operable to sealingly engage the annular relief channel when located therein so as to define the closed seal position of the annular seal body.

35. The fluid diverter tool according to claim 34, wherein the annular seal body is affixed to a seal sleeve slidably disposed on the mandrel for allowing said longitudinal movement of the annular seal body between the closed seal position and the first open seal position at the first side of the packer element; and wherein the seal sleeve is biased towards the closed seal position, thereby also biasing the annular seal body towards the closed seal position.

36. The fluid diverter tool according to claim 33, comprising a releasable holding mechanism operable to releasably hold said seal body in an open holding position at the first side of the packer element before operating the diverter tool in said pipe body.

37. The fluid diverter tool according to claim 31, wherein the packer element comprises one of:

a radially extending collar adapted and operable to sealingly engage the inside of said pipe body; and an expandable packer adapted and operable to expand radially to sealingly engage the inside of said pipe body.

* * * * *